US011913710B2

(12) United States Patent
Kang et al.

(10) Patent No.: US 11,913,710 B2
(45) **Date of Patent: *Feb. 27, 2024**

(54) REFRIGERATOR

(71) Applicant: LG Electronics Inc., Seoul (KR)

(72) Inventors: Daekil Kang, Seoul (KR); Jongmoon Jang, Seoul (KR); Hyunae Lim, Seoul (KR); Dongwoo Park, Seoul (KR); Seongyong Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/143,716

(22) Filed: May 5, 2023

(65) Prior Publication Data

US 2023/0272966 A1 Aug. 31, 2023

Related U.S. Application Data

(63) Continuation of application No. 17/333,760, filed on May 28, 2021, now Pat. No. 11,674,743.

(30) Foreign Application Priority Data

May 28, 2020 (KR) ..... 10-2020-0064229
Jun. 1, 2020 (KR) ..... 10-2020-0065624

(51) Int. Cl.
*F25D 23/02* (2006.01)
*A47B 96/20* (2006.01)

(52) U.S. Cl.
CPC ..... *F25D 23/028* (2013.01); *A47B 96/20* (2013.01); *A47B 2096/207* (2013.01); *A47B 2096/208* (2013.01); *A47B 2096/209* (2013.01)

(58) Field of Classification Search
CPC ..... F25D 2400/18; F25D 23/028; F25D 2323/02; A47B 2096/207; A47B 2096/208; A47B 2096/209; A47B 96/20
See application file for complete search history.

(56) References Cited

U.S. PATENT DOCUMENTS 11,674,743 B2 * 6/2023 Kang ..... A47B 96/20 312/116
2021/0071934 A1 * 3/2021 Lee ..... F25D 23/02

FOREIGN PATENT DOCUMENTS

DE 102018216349 A1 * 3/2020 ..... F25D 23/028

* cited by examiner

*Primary Examiner* — Andrew M Roersma
(74) *Attorney, Agent, or Firm* — Fish & Richardson P.C.

(57) ABSTRACT

A refrigerator includes a cabinet having a storage space, and a door configured to open and close the storage space, in which the door includes a frame assembly configured to open and close the storage space, and a panel assembly detachably coupled to the frame assembly and configured to form a front outer appearance of the door, the frame assembly includes an upper extension part extending forward and a first coupling part provided on the upper extension part, the panel assembly includes a front panel, and an upper bracket coupled to a rear upper part of the front panel and having a second coupling part coupled to the first coupling part, and the panel assembly moves upward in a state where the second coupling part of the panel assembly is positioned below the first coupling part, so that the second coupling part is coupled to the first coupling part.

20 Claims, 24 Drawing Sheets

FIG. 10
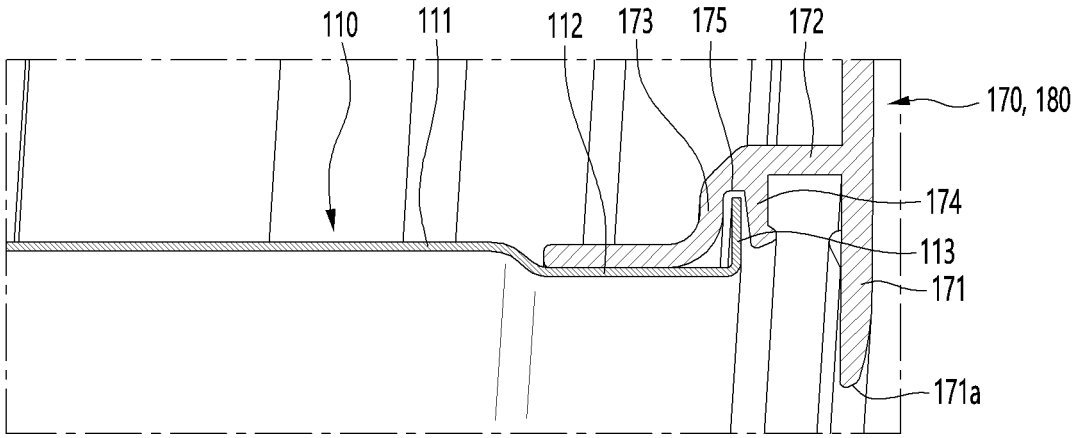
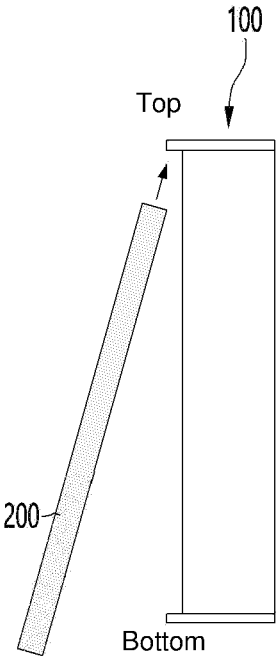
FIG. 11A
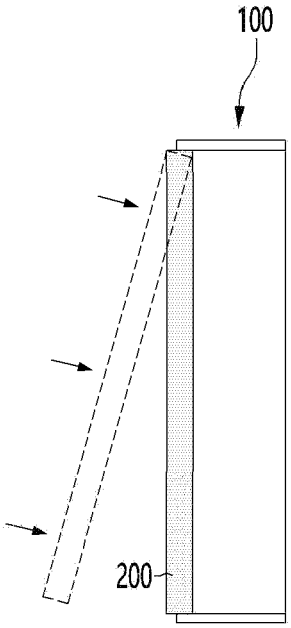
FIG. 11B
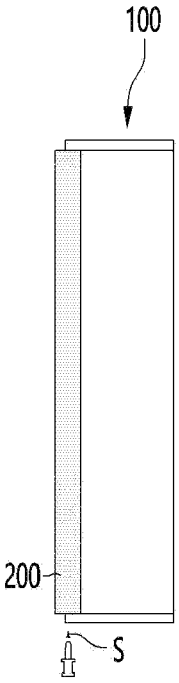
FIG. 11C

REFRIGERATOR

CROSS-REFERENCE TO RELATED APPLICATIONS

The present application is a continuation of U.S. application Ser. No. 17/333,760, filed on May 28, 2021, which claims priority under 35 U.S.C. 119 and 35 U.S.C. 365 to Korean Patent Application No. 10-2020-0064229, filed on May 28, 2020, and Korean Patent Application No. 10-2020-0065624, filed on Jun. 1, 2020, which are hereby incorporated by reference in their entirety.

FIELD

The present specification relates to a refrigerator.

BACKGROUND

The door of the refrigerator constitutes the front surface of the refrigerator. The user opens the door of the refrigerator to take out food stored in the refrigerator and closes the door to cool and store food in the refrigerator.

In this way, the door of the refrigerator is a component mainly operated by the user and has to be configured to be easily opened or closed, and it is necessary to be rigidly configured so that damage or failure of the door does not occur in this process.

The door of the refrigerator includes a frame forming a skeleton and a panel member provided in front of the frame. The panel member may form a front outer appearance of the door.

Meanwhile, the design, that is, shape, material, or color, of the refrigerator door may be an important criterion for a consumer to purchase a refrigerator. Since the shape, material, or color of the desired door is different for each customer, a uniformly manufactured door design may lower the user's desire to purchase.

There is an inconvenience that even if the user wants to change the design of the door while using the refrigerator, the design change is limited and thus a refrigerator of another model should be purchased.

In response to such a consumer's request, the refrigerator door is provided so that the panel member is detachable, and the manufacturer can provide a customized panel member suitable for the consumer preferences.

The following prior art is disclosed in relation to a door of a refrigerator having a detachable panel member.

[Prior Document 1]

Japanese Patent Publication No. 6460832 (Registration Date: Jan. 11, 2019)

The cooling utility door disclosed in Prior Document 1 is provided with a glass panel in front of the support part and is configured to additionally provide an attachment part provided detachably to the support part of the glass panel.

The attachment part may include an adhesive plate, and the front surface of the adhesive plate may be configured to adhere to the edge of the glass panel by an adhesive.

According to Prior Document 1, there are the following problems.

Since the glass panel and the adhesive plate adhere through the adhesive, once the glass panel is assembled, the glass panel may not be easily removed due to the adhesive.

In addition, when the support part and the attachment part are provided only in the lower part of the door and are fastened to each other through a screw, there may be a problem that the support force for the glass panel is weakened.

In addition, when a plurality of recessed parts are formed in the front of the support part, and a plurality of attachment parts are provided in the vertical direction and are configured to be inserted into the recessed parts of the support part, the assembly thereof has to be performed by aligning the recessed parts and the attachment parts of the support part and moving the glass panel to the rear, and thus there is a problem that the assembly process is complicated and difficult.

[Prior Document 2]

Chinese Utility Model Publication No. 207299701U (Published date: May 1, 2018)

A refrigerator having a detachable panel disclosed in Prior Document 2 discloses a technique of attaching and detaching the panel using a magnetic strip.

[Prior Document 3]

Japanese Utility Model Publication S59-13990U (Published date: Jan. 27, 1984)

The door device disclosed in Prior Document 3 discloses a technique of attaching and detaching a panel using a magnet.

According to Prior Documents 2 and 3, there are the following problems.

When the panel is attached and detached using a magnetic member, the detaching and detaching process of the panel may be easily performed, but a problem related to detachment of the panel may occur due to the weakening of the magnetic force. In particular, the panel may be unintentionally removed due to an impact caused by repetitive opening and closing of the door.

Since the panel may be attached by magnetic force even if the panel is not placed in the correct position, there is a possibility that the panel may be assembled at the wrong position according to the user's mistake.

SUMMARY

The present embodiment provides a refrigerator in which a front panel can be replaced without space constraints.

Alternatively or additionally, the present embodiment provides a refrigerator in which the panel assembly can be fixed in a state where the panel assembly is seated on the frame assembly so that the user can mount the panel assembly with little effort.

Alternatively or additionally, the present embodiment provides a refrigerator in which relative movement of the panel assembly coupled to the frame assembly relative to the frame assembly by an external force is limited.

Alternatively or additionally, the present embodiment provides a refrigerator in which a panel assembly is prevented from being separated from a frame assembly in a process of a moving process or an installation process of the refrigerator.

A refrigerator according to an aspect includes: a cabinet having a storage space; and a door configured to open and close the storage space.

The door may include a frame assembly configured to open and close the storage space and a panel assembly detachably coupled to the frame assembly and configured to form a front outer appearance of the door.

The frame assembly may include an upper extension part extending forward and a first coupling part provided on the upper extension part.

The panel assembly may include a front panel, and an upper bracket coupled to a rear upper part of the front panel and having a second coupling part coupled to the first coupling part.

The panel assembly may move upward in a state where the second coupling part of the panel assembly is positioned below the first coupling part, so that the second coupling part may be coupled to the first coupling part.

The first coupling part may be a coupling protrusion protruding downward from the upper extension part, the second coupling part may be a coupling groove in which the coupling protrusion is received, and the coupling protrusion may be received in the coupling groove in a process in which the panel assembly moves upward.

The upper bracket further may include a first locking part positioned lower than the coupling groove. The frame assembly may include a second locking part configured to support the first locking part in a process of moving a lower part of the panel assembly in a direction close to the frame assembly in a state where a part of the coupling protrusion is received in the coupling groove.

The second locking part may include a slot configured to receive the first locking part, and a support protrusion protruding upward from a bottom of the slot to support a lower surface of the first locking part.

The frame assembly may include a front frame, a door liner spaced apart from the front frame, an upper frame configured to connect an upper part of the front frame and an upper part of the door liner, and a lower frame configured to connect a lower part of the front frame and a lower part of the door liner.

The upper frame may include the upper extension part and the first locking part.

The front panel may be formed of metal material and include an upper flange part extending from an upper side of the front panel in a horizontal direction. The upper flange part may be seated on the upper surface of the upper bracket, and have a through-hole through which the coupling protrusion passes.

A front end part of the upper extension part may be formed to be rounded downward, and the front end part of the upper extension part may be positioned lower than at least a part of an upper surface of the upper flange part.

The front panel may be formed of glass material and includes a front surface, an upper surface, and a connection surface configured to connect the front surface and the upper surface. At least a part of the connecting surface may be formed to be rounded, a front end part of the upper extension part may be formed to be rounded downward.

The front end part of the upper extension part may be positioned lower than an upper surface of the front panel.

The panel assembly may further include a lower bracket disposed at a position spaced from a lower side of the upper bracket.

The frame assembly may include a support part configured to support the lower bracket in a process of moving a lower part of the panel assembly in a direction close to the frame assembly in a state where a part of the coupling protrusion is received in the coupling groove.

The refrigerator may further include a fastening member which penetrates the support part from a lower side of the support part and is fastened to the support part and the lower bracket.

The front panel may be formed of metal material and include a lower flange part extending in a horizontal direction from a lower side of the front panel. The lower flange part may be in contact with a lower surface of the lower bracket and include a fastening hole through which the fastening member passes.

A front end part of the support part may be formed to be rounded upward. An upper end of the front end part of the support part may be located higher than a part of a lower surface of the lower flange part.

The front panel may be made of glass material and include a front surface, a lower surface, and a connection surface configured to connect the front surface and the lower surface. At least a part of the connecting surface may be rounded. A front end part of the support part may be formed to be rounded upward. An upper end of the front end part of the support part may be located higher than the lower surface of the front panel.

The frame assembly may include a front frame and side frames coupled to both end parts of the front frame. The side frame may include a first part configured to cover at least a part of a side surface of the front panel, and a coupling part extending from the first part and coupled to the front frame.

The panel assembly may include a magnet coupled to a rear surface of the front panel. The front frame may be made of metal.

The front panel may include a pair of side flange parts which are bent rearward from both sides. The magnet may be disposed at a position adjacent to each of the side flange parts.

Each of the side flange parts may include a first flange bent at the rear surface of the front panel, and a bent part bent at the first flange and facing the rear surface of the front panel. The first part may be in contact with the first flange.

The panel assembly may include a side bracket attached to the rear surface of the front panel, and a frame coupling part coupled to the side bracket.

The frame coupling part may include a connection part connected to the side bracket, an extension part extending from the connection part, and a hook part formed at an end part of the extension part.

The hook part may be coupled to a space between the coupling part of the side frame and the first part.

An engagement protrusion for engaging the hook part may be formed on each of the coupling parts of the side frame and the first part.

The coupling part of the side frame may include a second part extending from the first part in a crossing direction, a third part extending from the second part and rounded forward, and a fourth part provided between the third part and the first part.

The hook part may be received between the fourth part and the first part.

A refrigerator according to another aspect may include a cabinet having a storage space and a door configured to open and close the storage space, in which the door may include a frame assembly configured to open and close the storage space; and a panel assembly detachably coupled to the frame assembly and forming a front outer appearance of the door.

The frame assembly may include an extension part extending forward, a first coupling part provided in the extension part, and a support part spaced apart from the extension part in a downward direction of the extension part, The panel assembly may include a front panel, an upper bracket coupled to a rear upper part of the front panel and having a second coupling part coupled to the first coupling part, and a lower bracket spaced apart from the upper bracket in a downward direction of the upper bracket.

The panel assembly may be moved upward in a state where the second coupling part of the panel assembly is located below the first coupling part so that the second coupling part is coupled to the first coupling part, and when the lower part of the panel assembly is moved in a direction close to the support part in a state where the second coupling part is coupled to the first coupling part, the lower bracket may be supported by the support part.

The refrigerator may further include a fastening member which is fastened to the lower bracket through the support part from a lower side of the support part.

A refrigerator according to another aspect includes a cabinet having a storage space; and a door configured to open and close the storage space, in which the door includes a frame assembly configured to open and close the storage space; and a panel assembly that is detachably coupled to the frame assembly and includes a front panel forming a front outer appearance of the door.

The refrigerator further includes a locking mechanism configured to couple at least one of both sides of the panel assembly to the frame assembly.

The locking mechanism may include a locking part protruding from the frame assembly, a locking groove provided in the panel assembly and receiving the locking part, and a fixing member configured to move the locking member so that the locking part engages the engagement part provided in the panel assembly in a state where the locking part is received in the locking groove.

When the locking part engages the engagement part by the movement of the fixing member, relative movement of the panel assembly with respect to the frame assembly by an external force may be limited.

The locking member may include a locking part extending from the body part.

The body part may include a coupling surface which is located opposite the locking part and to which the fixing member is coupled.

The upper surface of the locking part may include an inclined surface inclined downward in a direction away from the coupling surface and a plane extending from the inclined surface, and an engagement protrusion for engaging the engagement part may be provided at an end part of the plane.

The lower surface of the locking part may be inclined downward in a direction away from the coupling surface.

The frame assembly may include a front frame, a door liner spaced apart from the front frame in a first direction, and a side panel positioned in a region connecting the front frame and the door liner or corresponding between the front frame and the door liner.

The locking member may be installed on the side panel to be movable in the first direction. The side panel may include a body extending in the first direction, a first extension part extending in a horizontal direction from a front end of the body, and a second extension part extending in a horizontal direction from a rear end of the body. The locking member may pass through the first extension part and protrude forward of the first extension part.

The first extension part may include a first hole through which the locking member passes, and the second extension part may include a second hole through which the fixing member penetrates. The body part may be positioned between the first extension portion and the second extension portion, and the locking part may penetrate the first hole.

In a process in which the locking part is inserted into the locking groove, the engagement part presses the inclined surface of the locking part so that the locking member may move in the first direction.

When the fixing member is rotated in one direction, the coupling surface moves in a direction closer to the second extension part, so that the locking part may engage the engagement part.

The panel assembly may include a side bracket attached to a rear surface of the front panel, and the locking groove may be provided in the side bracket.

The locking groove may include a first groove extending in a front and rear horizontal direction, and a second groove extending upward from the first groove.

The length of the second groove in the front and rear direction is shorter than the length of the first groove in the front and rear direction. The engagement part may be provided at a part where the second groove is located.

When the fixing member is rotated in one direction, the engagement protrusion provided in the locking part moves from the first groove to the second groove so that the engagement protrusion may engage the engagement part. When the fixing member is rotated in another direction, the engagement protrusion may move from the second groove to the first groove by the self-weight of the locking member.

BRIEF DESCRIPTION OF THE DRAWINGS

FIG. 10 is a view illustrating a state where the side frame is coupled to the front frame.

FIGS. 11A to 11C are views schematically illustrating a process in which the panel assembly of the present embodiment is coupled to the frame assembly.

DETAILED DESCRIPTION OF THE EMBODIMENTS

Figure 1:
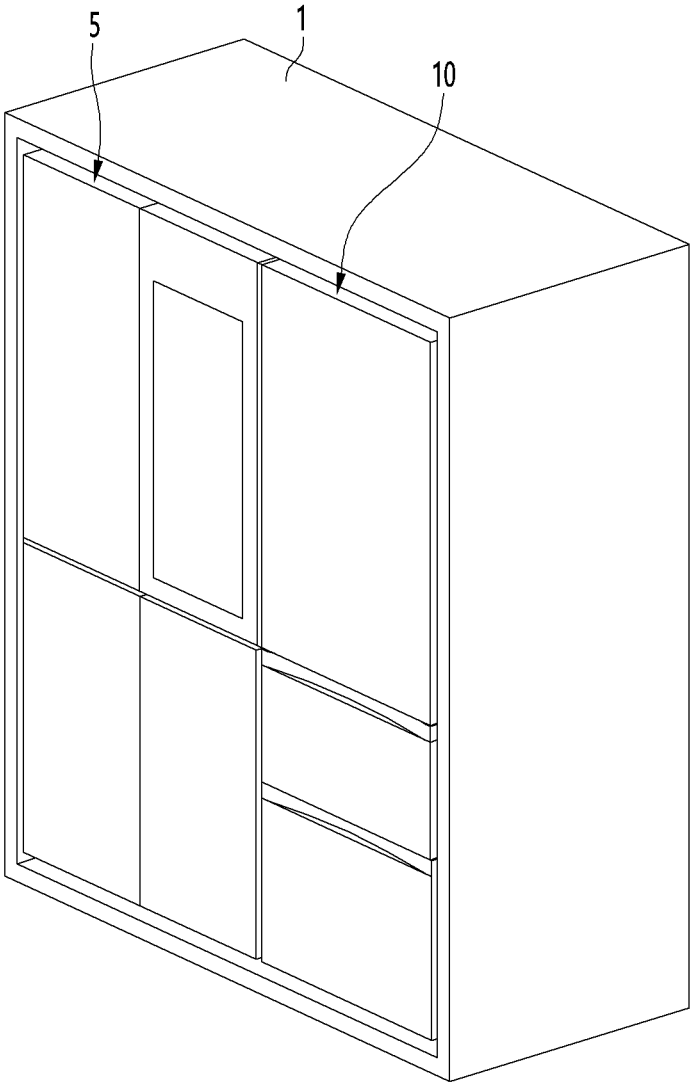
FIG. 1 is a view illustrating a state where a refrigerator according to a first embodiment of the present disclosure is installed in a furniture cabinet.
Figure 2:
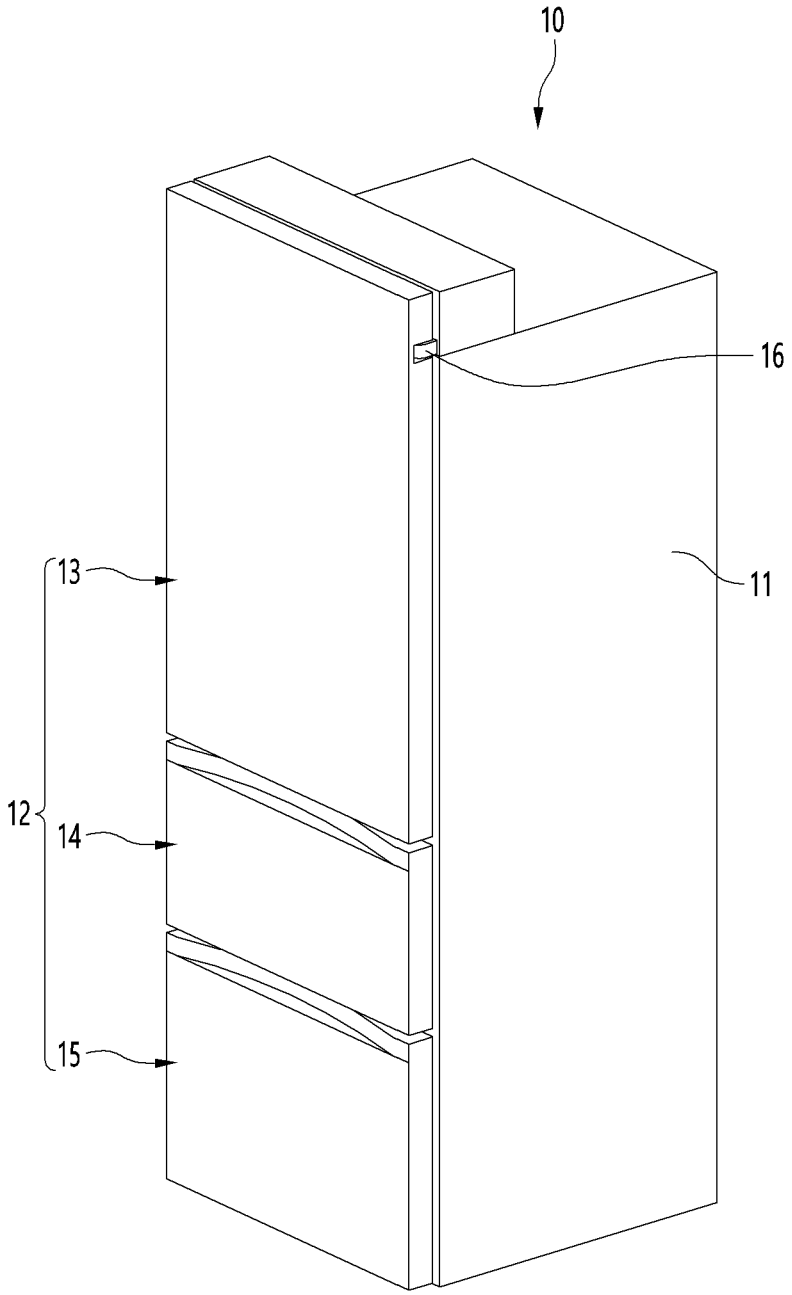
FIG. 2 is a perspective view illustrating a refrigerator according to a first embodiment of the present disclosure.
Figure 3:
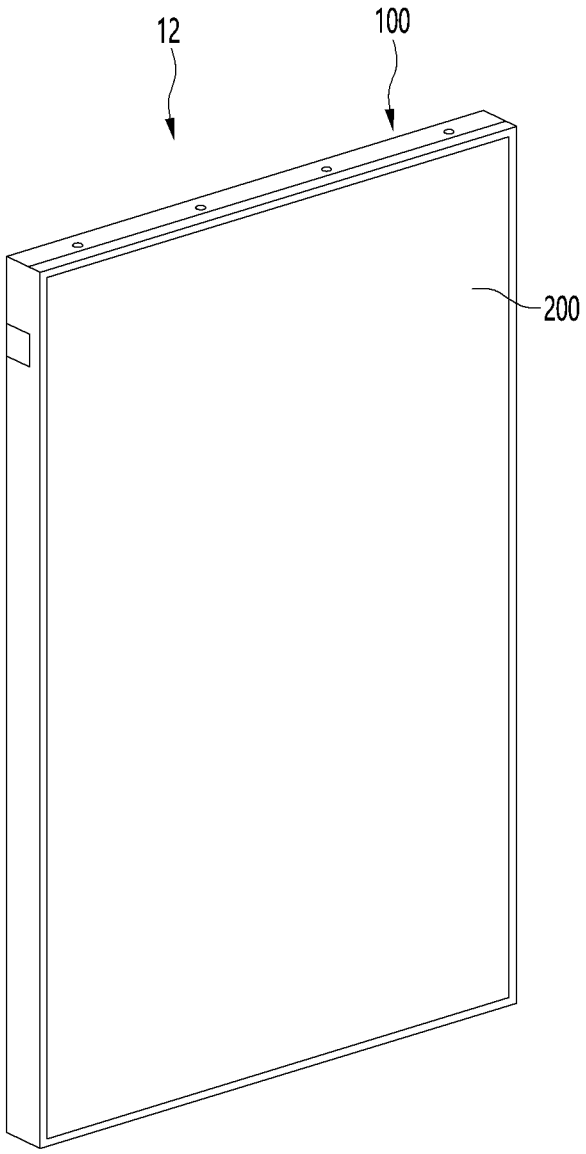
FIG. 3 is a perspective view illustrating a refrigerator door according to a first embodiment of the present disclosure.

FIG. 1 is a view illustrating a state where a refrigerator according to a first embodiment of the present disclosure is installed in a furniture cabinet, FIG. 2 is a perspective view illustrating a refrigerator according to a first embodiment of the present disclosure, and FIG. 3 is a perspective view illustrating a refrigerator door according to a first embodiment of the present disclosure.

Referring to FIGS. 1 to 3, the refrigerator 10 according to the present embodiment may be placed in a kitchen, living room, or the like independently or together with another refrigerator 5.

In this case, a furniture cabinet 1 or a wall in which the refrigerators 5 and 10 can be received may be provided in the kitchen, living room, or the like. Hereinafter, it will be described, as an example, that the refrigerators 5 and 10 are received in the furniture cabinet 1.

The height of the receiving space inside the furniture cabinet 1 can be set such that the gap between the upper surfaces of the refrigerators 5 and 10 and the upper wall of the furniture cabinet 1 is not large in a state where the refrigerators 5 and 10 are received therein.

If the gap between the upper surface of the refrigerator 5 and 10 and the upper wall of the furniture cabinet 1 is not large, the upper structure of the refrigerator 5 and 10 is not visible from the outside, and the sense of unity between the furniture cabinet 1 and the refrigerators 5 and 10 may increase.

The refrigerator 10 may include a cabinet 11 having a storage space and a refrigerator door 12 configured to open and close the storage space.

The refrigerator door 12 may include a plurality of doors 13, 14, and 15 spaced apart in the vertical direction. Some or all of the plurality of doors 13, 14, and 15 may open and close the storage space in a sliding method or a rotating method.

The refrigerator door 12 may include a frame assembly 100 forming an external shape and a panel assembly 200 detachably coupled to the frame assembly 100.

The panel assembly 200 may form at least a part or all of the front outer appearance of the refrigerator door 12. The front outer appearance of the refrigerator door 12 may substantially have the front outer appearance of the refrigerator 10.

Accordingly, the user can see the front surface of the panel assembly 200 from the front of the refrigerator 10. The front surface of the panel assembly 200 may serve as a decorative panel at a location where the refrigerator 10 is installed. In this embodiment, the panel assembly 200 may be replaced according to a user's preference.

In the following, the refrigerator door 12 will be described in which not only is it easy to replace the panel assembly 200, but even when the refrigerator 10 is received in the furniture cabinet 1, the panel assembly 200 can be replaced without space constraints.

Figure 4:
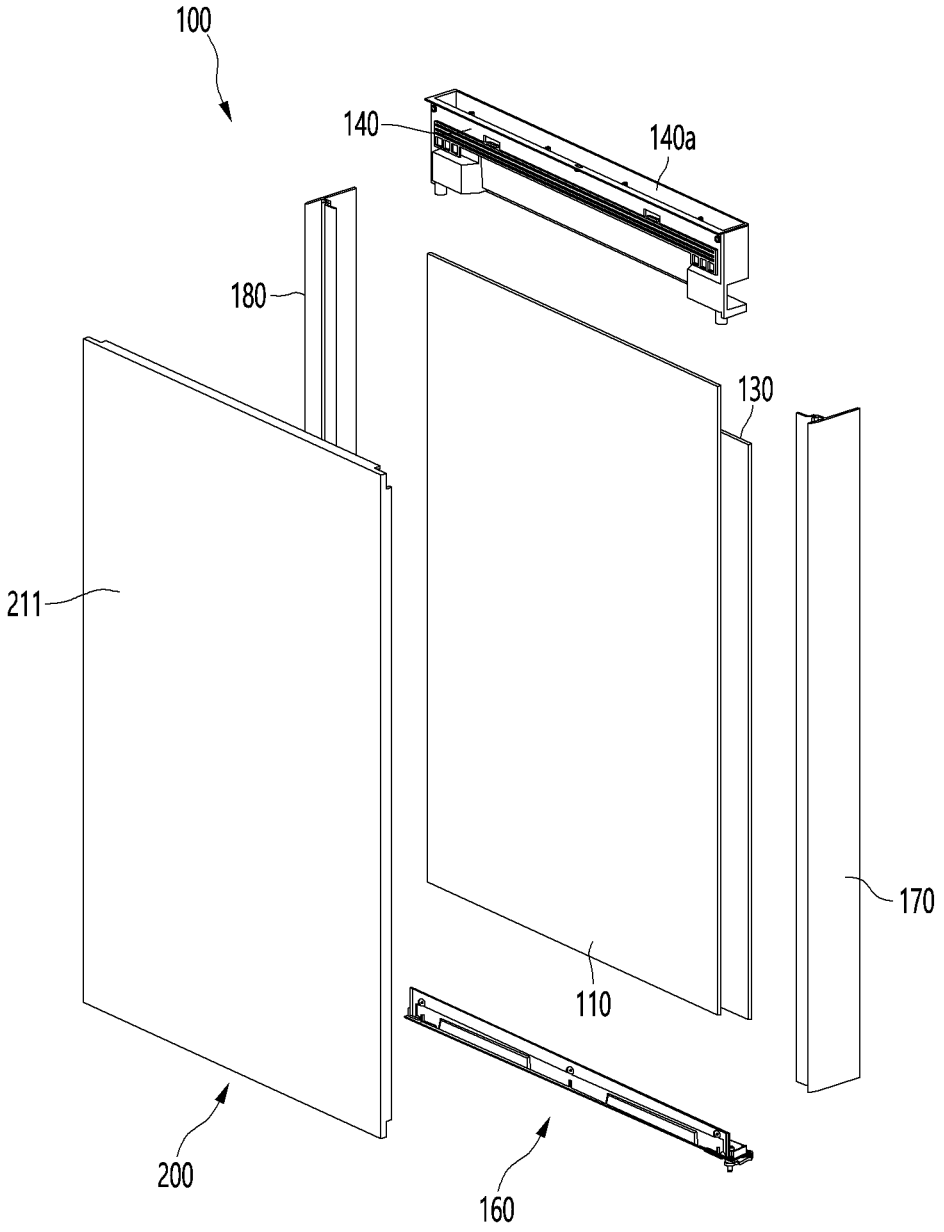
FIG. 4 is an exploded perspective view illustrating a refrigerator door according to a first embodiment of the present disclosure.
Figure 5:
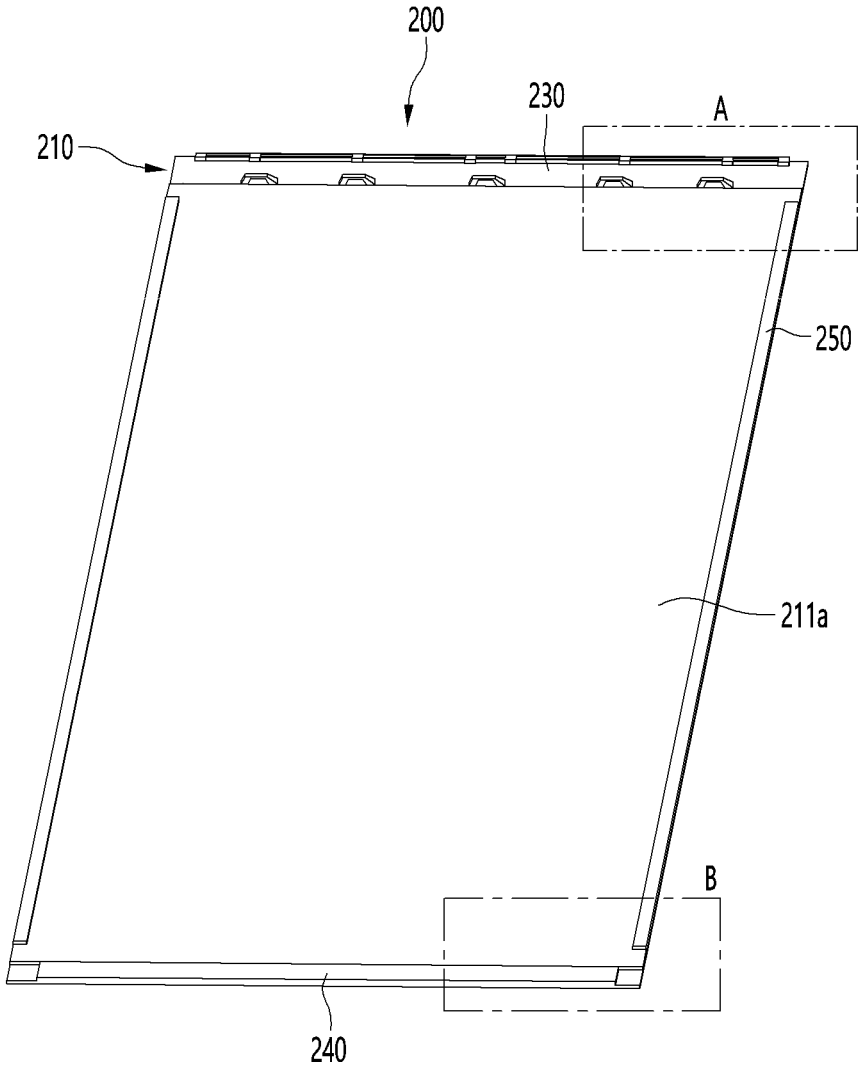
FIG. 5 is a perspective view illustrating the rear side of the panel assembly according to the first embodiment of the present disclosure.
Figure 6:
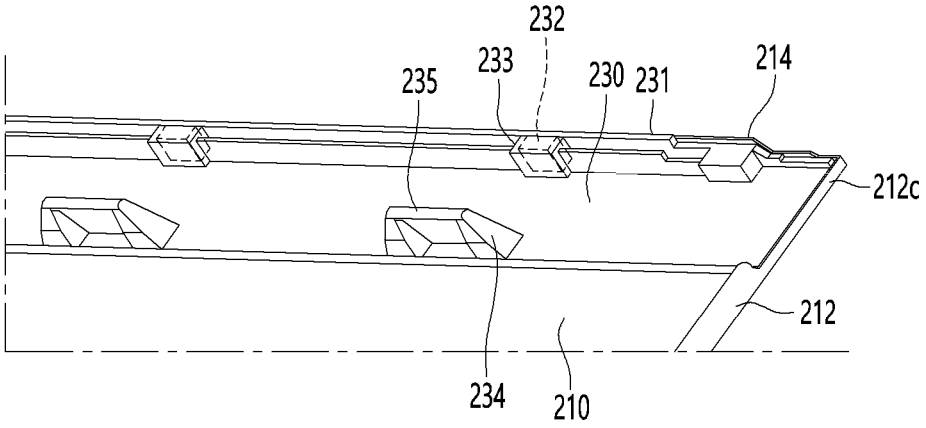
FIG. 6 is an enlarged view illustrating part A of FIG. 5.
Figure 7:
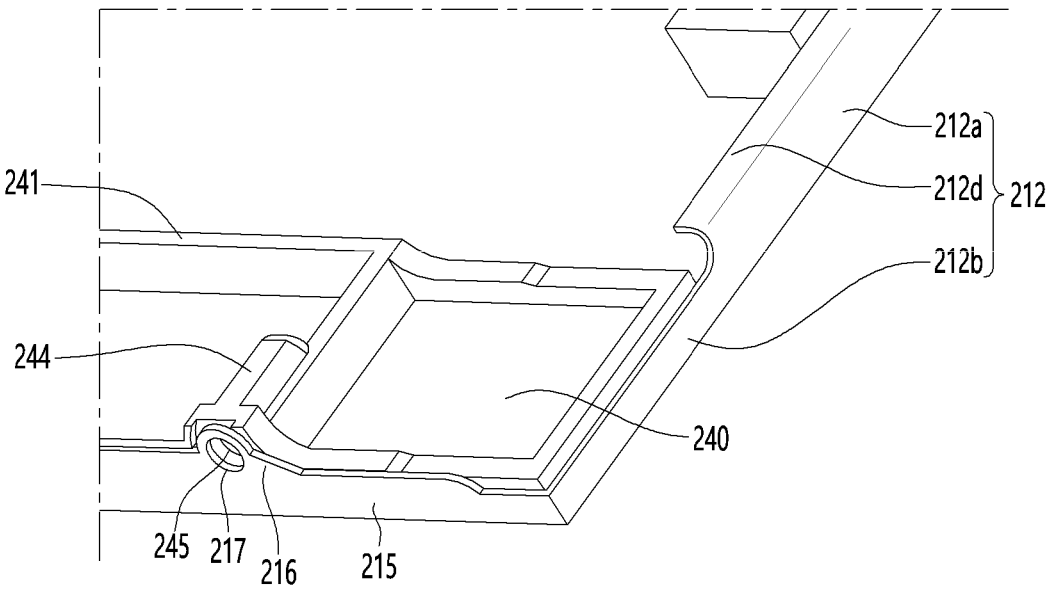
FIG. 7 is an enlarged view illustrating part B of FIG. 5.

FIG. 4 is an exploded perspective view illustrating a refrigerator door according to a first embodiment of the present disclosure, FIG. 5 is a perspective view illustrating the rear side of the panel assembly according to the first embodiment of the present disclosure, FIG. 6 is an enlarged view illustrating part A of FIG. 5, and FIG. 7 is an enlarged view illustrating part B of FIG. 5.

Referring to FIGS. 4 to 7, the refrigerator door 12 may include a frame assembly 100 and a panel assembly 200 detachably connected to the frame assembly 100, as described above.

The frame assembly 100 may include a front frame 110 and a door liner 130 positioned behind the front frame 110. The door liner 130 may be coupled to the front panel 210 while a part of the door liner 130 is spaced apart from the front panel 210. Accordingly, an insulating space for receiving insulating material may be formed between the front frame 110 and the door liner 130.

The front frame 110 may be formed of, for example, metal material having a low degree of deformation due to an external force. The front frame 110 may be formed in a plate shape, for example.

The frame assembly 100 may further include an upper frame 140 connected to an upper side of the front frame 110 and a lower frame 160 connected to a lower side of the front frame 110.

The upper frame 140 may cover an upper side of the insulating space, and the lower frame 160 may cover a lower side of the insulating space.

The frame assembly 100 may further include a plurality of side frames 170 and 180 forming a side outer appearance of the refrigerator door 12.

As an example, the plurality of side frames 170 and 180 may include a first side frame 170 and the second side frame 180.

Each of the side frames 170 and 180 may directly connect the front frame 110 and the door liner 130 or cover a connection portion between the front frame 110 and the door liner 130.

The side frames 170 and 180 may be formed of metal material, and for example, but are not limited thereto, may be formed of aluminum material.

The panel assembly 200 may include a front panel 210. The front panel 210 may be formed of metal material or glass material. Hereinafter, an example in which the front panel 210 is formed of metal material will be described. Regardless of the material of the front panel 210, the structure for detachably coupling the panel assembly 200 to the frame assembly 100 may be the same.

In the front panel 210, the front surface 211 is a surface forming the outer appearance of the door, and the rear surface 211*a* refers to the opposite surface of the front surface 211. Accordingly, the front of the front panel 210 is in a direction away from the rear surface with respect to the front surface 211, and the rear of the front panel 210 is in a direction away from the front surface 211 with respect to the rear surface 211*a*.

The front panel 210 may include a flange part whose upper and lower ends and left and right ends are bent toward the rear of the front panel 210. For example, the front panel 210 may include four flange parts.

The flange part may include an upper flange part 214, a lower flange part 215, and a pair of side flange parts 212.

The panel assembly 200 may further include a bracket assembly installed on the rear surface 211*a* of the front panel 210.

The bracket assembly may be attached to an edge part of the rear surface 211*a* of the front panel 210 by an adhesive or double-sided tape. The bracket assembly may contact the flange part of the front panel 210.

The bracket assembly may be composed of one or a plurality of brackets. In FIG. 5, as an example, it is illustrated that the bracket assembly includes a plurality of brackets.

The bracket assembly may include an upper bracket 230 and a lower bracket 240 disposed to be spaced apart from the upper bracket 230 in the vertical direction. The upper bracket 230 and the lower bracket 240 may have different structures.

The upper bracket 230 may be coupled to the upper frame 140. Accordingly, by the upper bracket 230 and the upper frame 140, the refrigerator door 12 may include an upper coupling mechanism for coupling the upper part of the panel assembly 200 to the frame assembly 100 (or a first coupling mechanism).

The lower bracket 240 may be coupled to the lower frame 160. Accordingly, by the lower bracket 240 and the lower frame 160, the refrigerator door 12 may further include a lower coupling mechanism for coupling the lower part of the panel assembly 200 to the frame assembly 100 (or a second coupling mechanism).

In the present embodiment, the panel assembly 200 may be basically coupled to the frame assembly 100 by the upper coupling mechanism and the lower coupling mechanism.

After the panel assembly 200 is coupled to the frame assembly 100 by the upper coupling mechanism and the lower coupling mechanism, unless the user performs a task for separating the panel assembly 200, separation of the panel assembly 200 from the frame assembly 100 may be prevented.

The refrigerator door 12 may further include an additional coupling mechanism so that the entire part of the panel assembly 200 is firmly coupled to the frame assembly 100 and deformation is prevented in the coupled state.

As an example, the panel assembly 200 may further include a side coupling mechanism (or a third coupling mechanism) for coupling both sides thereof to the frame assembly 100. The side coupling mechanism may be, for example, a magnet 250. The magnet 250 may be disposed at a position adjacent to each of the side flange parts 212. The magnet may be attached to the rear surface 211*a* of the front panel 210 by an adhesive or tape.

As an example, a magnet having a vertical length longer than that of the left and right widths may be disposed so as to be adjacent to each side flange part 212. Alternatively, a plurality of magnets arranged in the vertical direction may be disposed so as to be adjacent to each side flange part 212.

The magnet 250 may be in contact with the front surface of the front frame 110. The upper end of the magnet 250 may be spaced apart from the lower end of the upper bracket 230, and the lower end of the magnet 250 may be spaced apart from the upper end of the lower bracket 240.

In this case, before the upper bracket 230 is coupled to the upper frame 140, the magnet 250 may be prevented from being in contact with the front frame 100. In other words, if the magnet 250 is in contact with the front frame 250 before the upper bracket 230 is coupled to the upper frame 140, although there is a possibility that the upper bracket 230 is erroneously coupled to the upper frame 140, this phenomenon can be prevented according to the present embodiment.

The side flange part 212 may include a first flange 212*a*, a second flange 212*b* extending from both sides of the first flange 212*a* and having a height lower than that of the first flange part 212*a*, and a third flange 212*d* bent from the first flange 212*a*. Each of the first flange 212*a* and the second flange 212*b* extends in a direction crossing the rear surface 211*a* of the front panel 210.

The third flange 212*d* may be disposed so as to face the rear surface 211*a* in a state of being spaced apart from the rear surface 211*a* of the front panel 210.

The second flange 212*b* may be connected to the upper flange part 214 and the lower flange part 215. When the side flange part 212 includes a first flange 212*a* and a third flange 212*d* (or bent part) bent at the first flange 212*a* as in this embodiment, deformation of the side flange part 212 may be minimized.

Hereinafter, the coupling mechanisms will be described in detail.

Figure 8:
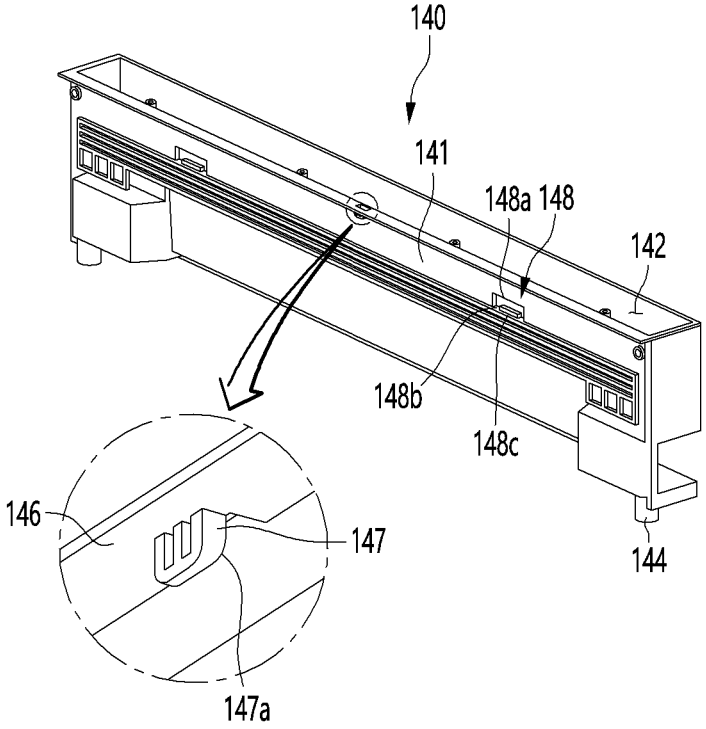
FIG. 8 is a perspective view illustrating an upper frame according to the first embodiment of the present disclosure.

FIG. 8 is a perspective view illustrating an upper frame according to the first embodiment of the present disclosure.

Referring to FIGS. 4 to 8, a part of the upper coupling mechanism may be provided on the upper bracket 230, and another part thereof may be provided on the upper frame 140.

The upper bracket 230 may be attached to the rear surface 211*a* of the front panel 210 by an adhesive or tape. At this time, when the upper bracket 230 is attached to the front panel 210 by an adhesive, so that the adhesive force between the upper bracket 230 and the front panel 210 increases, a groove 238 (see FIG. 12) may be formed on a surface of the front panel 210 facing the rear surface 211*a*. In this case, since the adhesive may be introduced into the groove, the bonding force between the upper bracket 230 and the front panel 210 by the adhesive may increase.

The upper bracket 230 may include a support part 231 supporting the upper flange part 214 of the front panel 210.

The upper bracket 230 may further include an extension part 233 extending downward from the support part 231. For example, a plurality of extension parts 233 may be disposed to be spaced apart in a horizontal direction.

The upper bracket 230 may be provided with a coupling groove 232 formed by being recessed toward the plurality of extension parts 233 on the upper surface of the support part 231. The coupling groove 232 may be referred to as a second coupling part.

The upper bracket 230 may further include a first locking part 234 located below the extension part 233, spaced apart therefrom. The first locking part 234 may include a locking shaft 235.

A portion of the front panel 210 where the upper flange part 214 is bent may provide the rotation center (or pivot center) of the panel assembly 200 when the panel assembly 200 is coupled to the frame assembly 100. Accordingly, the panel assembly 200 rotates (or pivots) during a coupling process, and the locking shaft 235 may have a round surface to prevent interference with a second locking part to be described later in the coupling process.

The upper frame 140 may include a frame body 141. The frame body 141 may be formed in a substantially rectangular parallelepiped shape, and the upper surface is recessed downward to form a space 142 therein. The space 142 may be a working space for coupling the hinges 16 provided in FIG. 2. The space 142 may be covered by the upper panel 140*a*.

The frame body 141 may include an upper extension part 146 extending in a horizontal direction from an upper end. The upper extension part 146 may be positioned above the front panel 210 in a state where the panel assembly 200 is coupled to the frame assembly 100. For example, the upper extension part 146 may cover the upper flange part 214 of the front panel 210.

The upper extension part 146 may be provided with a coupling protrusion 147 configured to be inserted into the coupling groove 232. The coupling protrusion 147 may be referred to as a first coupling part. A plurality of coupling protrusions 147 may be disposed to be spaced apart in a horizontal direction at the same height, and the plurality of coupling protrusions 147 may be provided in the same number as the plurality of coupling grooves 232.

At this time, since the upper flange part 214 is in contact with the upper surface of the upper bracket 230, a through-hole 214*b* (FIG. 12) through which the coupling protrusion 147 passes may be provided at a position corresponding to the coupling groove 232 in the upper flange part 214 so that the coupling protrusion 147 is received in the coupling groove 232.

In the process in which the panel assembly 200 is rotated, when the coupling protrusion 147 is inserted into the coupling groove 232, so that the coupling protrusion 147 is prevented from interfering with the support part 231, the coupling protrusion 147 may include a rounded lower surface.

The upper frame 140 may further include a second locking part 148 interacting with the first locking part 234. The second locking part 148 may be located under the coupling protrusion 147.

The second locking part 148 may include a slot 148*a* configured to receive the first locking part 234 and a support protrusion 148*c* configured to support the locking shaft 235 by protruding upward from the bottom 148*b* of the slot 148*a*.

The support protrusion 148*c* may include a round surface for preventing interference with the locking shaft 235 during a coupling process.

The height of the support protrusion 148*c* is smaller than the height of the slot 148*a*, and the left and right widths of the support protrusion 148*c* are smaller than the left and right widths of the slot 148*a*.

Meanwhile, the upper frame 140 may further include a guide part 144 which is inserted into the space between the front frame 110 and the door liner 130 and guides the coupling position of the upper frame 140. In addition, the upper frame 140 may further include a fastening hole 145 configured to be fastened to the front frame 110 by a screw.

The upper coupling mechanism may include the coupling protrusion 147 and the coupling groove 232 described above. The upper coupling mechanism may further include the first locking part 234 and the second locking part 148.

Meanwhile, referring to FIG. 7, the lower bracket 240 may include a bracket body 241. The bracket body 241 may be formed in an approximately rectangular parallelepiped shape.

The lower bracket 240 may be attached to the rear surface 211*a* of the front panel 210 by an adhesive or tape. At this time, when the lower bracket 240 is attached to the front panel 210 by an adhesive, so that the adhesive force between the lower bracket 240 and the front panel 210 increases, a groove 245 (see FIG. 15) may be formed on a surface of the front panel 210 facing the rear surface 211*a* from the lower bracket 240. In this case, since the adhesive may be introduced into the groove, the bonding force between the lower bracket 240 and the front panel 210 by the adhesive may increase.

The lower flange part 215 of the front panel 210 may be in contact with the lower surface of the bracket body 241.

The lower bracket 240 may be provided with a lower coupling part 244. The lower coupling part 244 protrudes from the bracket body 241.

The lower flange part 215 may further include an extension part 216 extending in the horizontal direction. The extension part 216 may be in contact with a lower surface of the lower coupling part 244. The lower coupling part 244 may include a coupling groove 245 for fastening the coupling member S. The coupling groove 245 may extend in the vertical direction. The extension part 216 may include a fastening hole 217 aligned with the coupling groove 245.

The fastening member S may be coupled to the coupling groove 245 after passing through the coupling hole 165 and the fastening hole 217 of the lower frame 160 to be described later. In other words, the fastening member S may fix the lower bracket 240 and the lower frame 160. Accordingly, the lower coupling mechanism may include the lower coupling part 244, the extension part 216 of the lower flange part 215, the coupling hole 165, and the fastening member S.

Figure 9:
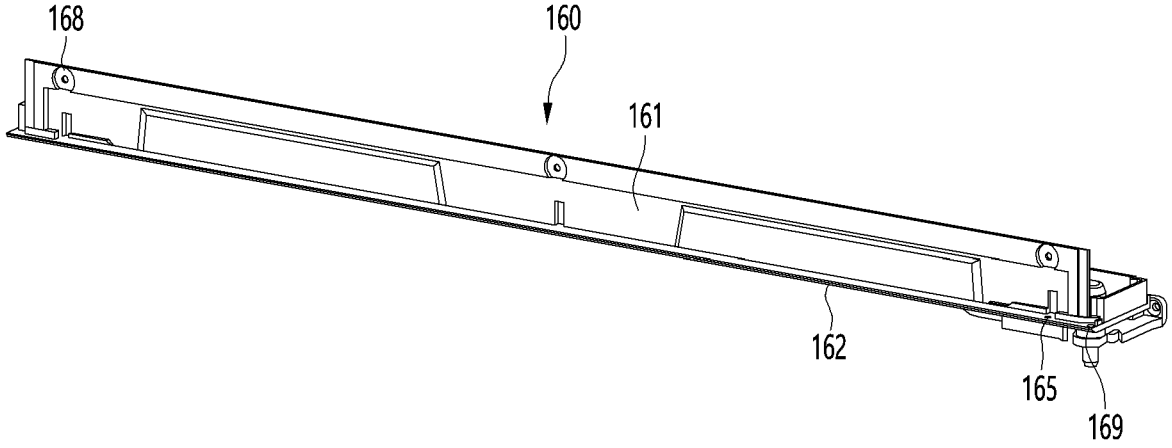
FIG. 9 is a perspective view illustrating a lower frame according to the first embodiment of the present disclosure.

FIG. 9 is a perspective view illustrating a lower frame according to the first embodiment of the present disclosure.

Referring to FIG. 9, the lower frame 160 may be coupled to the front frame 110 and support the front panel 210.

The lower frame 160 may include a lower frame body 161. The lower frame body 161 may include a fastening hole 168 through which a fastening member for fastening with the front frame 110 is fastened. The fastening hole 168 may be disposed on the upper part of the lower frame body 161.

The lower frame 160 may further include a support part 162 extending in a horizontal direction from a lower part of the lower frame body 161.

The support part 162 may be provided with a coupling hole 165 through which the fastening member S passes.

When the front panel 210 is seated on the support part 162, the coupling hole 165, the fastening hole 217, and the coupling groove 245 may be aligned in the vertical direction.

The support part 162 may be provided with a tool hole 169 into which a working tool for separating the panel assembly 200 coupled to the frame assembly 100 may be inserted. The tool hole 169 may be located at one end part of the support part 162. The working tool may be, for example, a pin, and when a pin is inserted into the tool hole 169, the pin pushes the third flange 212*d* of the side flange part 212 forward so that a part of the side surface of the panel assembly 200 is separated from the frame assembly 100.

FIG. 10 is a view illustrating a state where the side frame is coupled to the front frame.

Referring to FIG. 10, the front frame 110 may include a first portion 111 and a second portion 112 positioned closer to the front panel 210 than the first portion 111.

Referring to FIG. 10, the first portion 111 may extend in a horizontal direction, and the second portion 112 may be bent toward the front at both sides of the first portion 111 and then extend again in the horizontal direction.

The front frame 110 may further include a third portion 113 that is bent rearward from the second portion 112. The third portion 113 may be bent substantially vertically in the second portion 112, for example.

The second portion 112 may be in contact with the magnet 250 of the front panel 210, so that the second portion 112 and the magnet 250 may be coupled to each other. When the second portion 112 is disposed closer to the front panel 210 than the first portion 111 and the magnet 250 is in contact with the second portion 112, the thickness of the magnet 250 can be reduced, and accordingly, the weight of the front panel 210 can be reduced.

The side frames 170 and 180 may form a side outer appearance of the frame assembly 100.

The side frames 170 and 180 may include a first part 171 extending in the front and rear direction, a second part 172 extending from the first part 171 in a crossing direction at a position spaced rearward from the front end 171*a* of the first part 171, and a third part 173 extending from the second part 172 and rounded forward.

The third part 173 may include a round surface and a flat surface. The planar portion of the third part 173 may contact the rear surface of the second portion 112 of the front frame 110. The planar portion of the third part 173 may be bonded to the second portion 112 by an adhesive or tape.

A part of the third part 173 may be located between the first portion 111 and the third portion 113 of the front frame 211. For example, a plane of the third part 173 may be located between the first portion 111 and the third portion 113 of the front frame 211.

The front frame 211 may further include a fourth part 174 provided between the third part 173 and the first part 171. The fourth part 174 may extend forward from the second part 172. The fourth part 174 forms an insertion space 175 which is horizontally spaced apart from the third part 173 and into which the third portion 113 is inserted together with the third part 173.

Accordingly, the second part 172 to the fourth part 174 may be referred to as a coupling part.

Figure 12:
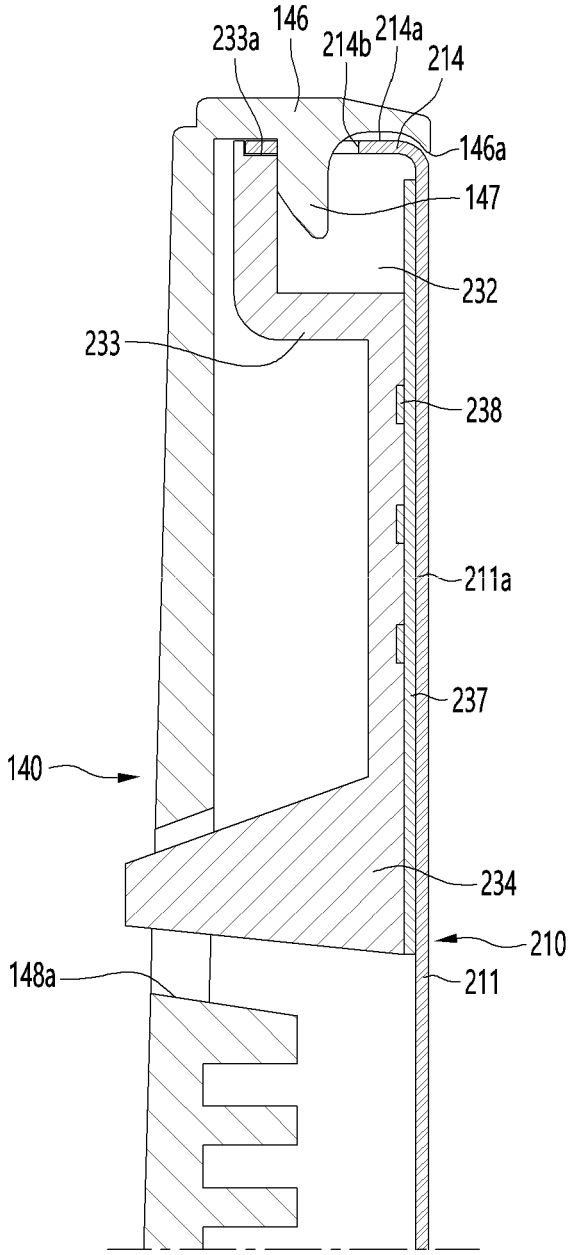
FIG. 12 is a view illustrating a state of a coupling protrusion and a coupling groove of the upper coupling mechanism before and after coupling the panel assembly and the frame assembly.
Figure 13:
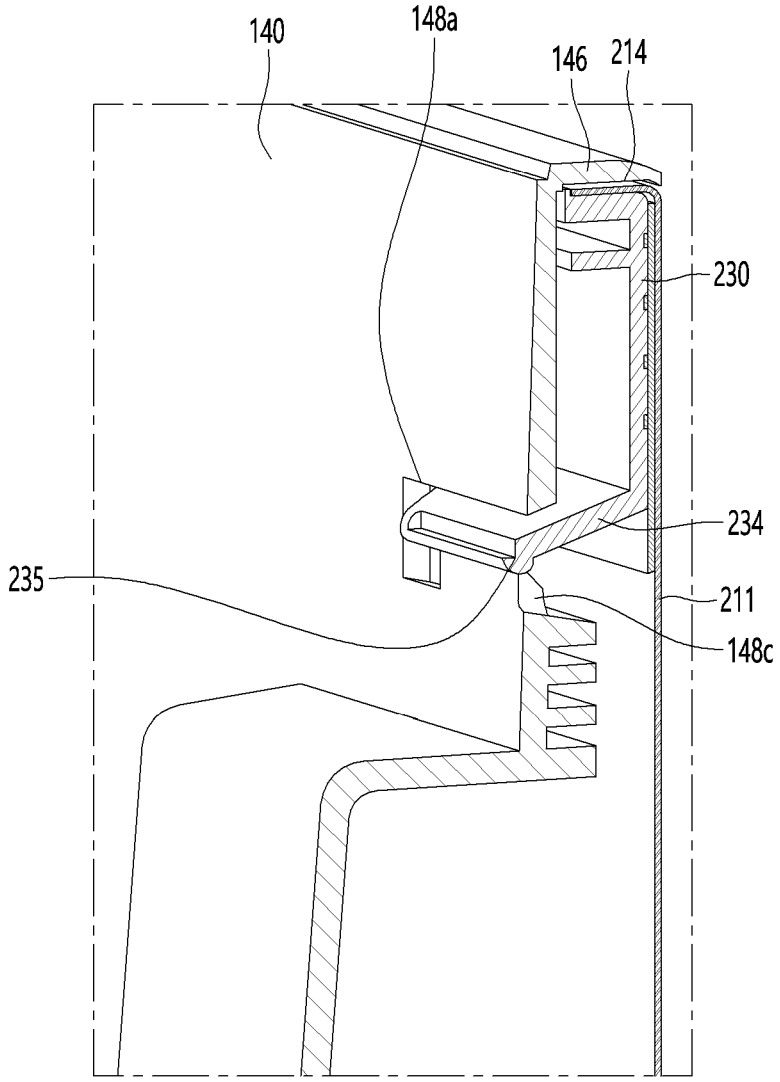
FIG. 13 is a view illustrating the state of a first locking part and a second locking part in a state where the panel assembly and the frame assembly are coupled.

FIGS. 11A to 11C are views schematically illustrating a process in which the panel assembly of the present embodiment is coupled to the frame assembly, FIG. 12 is a view illustrating a state of a coupling protrusion and a coupling groove of the upper coupling mechanism before and after coupling the panel assembly and the frame assembly, and FIG. 13 is a view illustrating the state of a first locking part and a second locking part in a state where the panel assembly and the frame assembly are coupled. Referring to FIGS. 11A to 11C to 13, in order to couple the panel assembly 200 to the frame assembly 100, first, the upper side of the panel assembly 200 may be coupled to the frame assembly 100 by the upper coupling mechanism.

As an example, as illustrated in FIG. 11A, a coupling groove 232 of the panel assembly 200 is positioned under the coupling protrusion 147 of the frame assembly 100 in a state where the panel assembly 200 is inclined by a predetermined angle with respect to the front surface of the frame assembly 100.

In this state, the panel assembly 200 moves upward in an inclined direction and the coupling protrusion 147 may pass through the through-hole 214*a* of the upper flange part 214 of the front panel 210 and may be received in the coupling groove 232 of the upper bracket 230.

In the case of the present embodiment, since the plurality of coupling protrusions 147 are disposed horizontally spaced apart from the same height, in a process of simply moving the panel assembly 200 upward, the coupling protrusion 147 may be received in the coupling groove 232, and thus the possibility that the coupling protrusion 147 is erroneously inserted into the coupling groove 232 may be minimized.

In addition, the panel assembly 200 may be coupled to the frame assembly 100 regardless of the large or small space above the frame assembly 100. In other words, there is no need to secure a working space above the frame assembly 100.

Then, the panel assembly 100 is rotated (or pivoted) so that the lower side of the panel assembly 200 is close to the frame assembly 100 as illustrated in FIG. 11B. Then, the first locking part 234 may be supported by the support protrusion 148*c* of the second locking part 148. At this time, it can be prevented that the first locking part 234 interferes with the support protrusion 148*c* during the rotation of the first locking part 234 by the round surface of the locking shaft 245 of the first locking part 234.

In addition, the front panel 210 may be supported by the support part 162 of the lower frame 160 in a state where the first locking part 234 is supported by the support protrusion 148*c*.

Therefore, since the support protrusion 148*c* and the support part 162 support the load of the panel assembly 200, even if the user does not grip the panel assembly 200, the position of the panel assembly 200 can be primarily fixed.

Accordingly, during subsequent operations, a user may exert a small amount of force and fix the panel assembly 200 to the frame assembly 100 by using the lower coupling mechanism.

Figure 14:
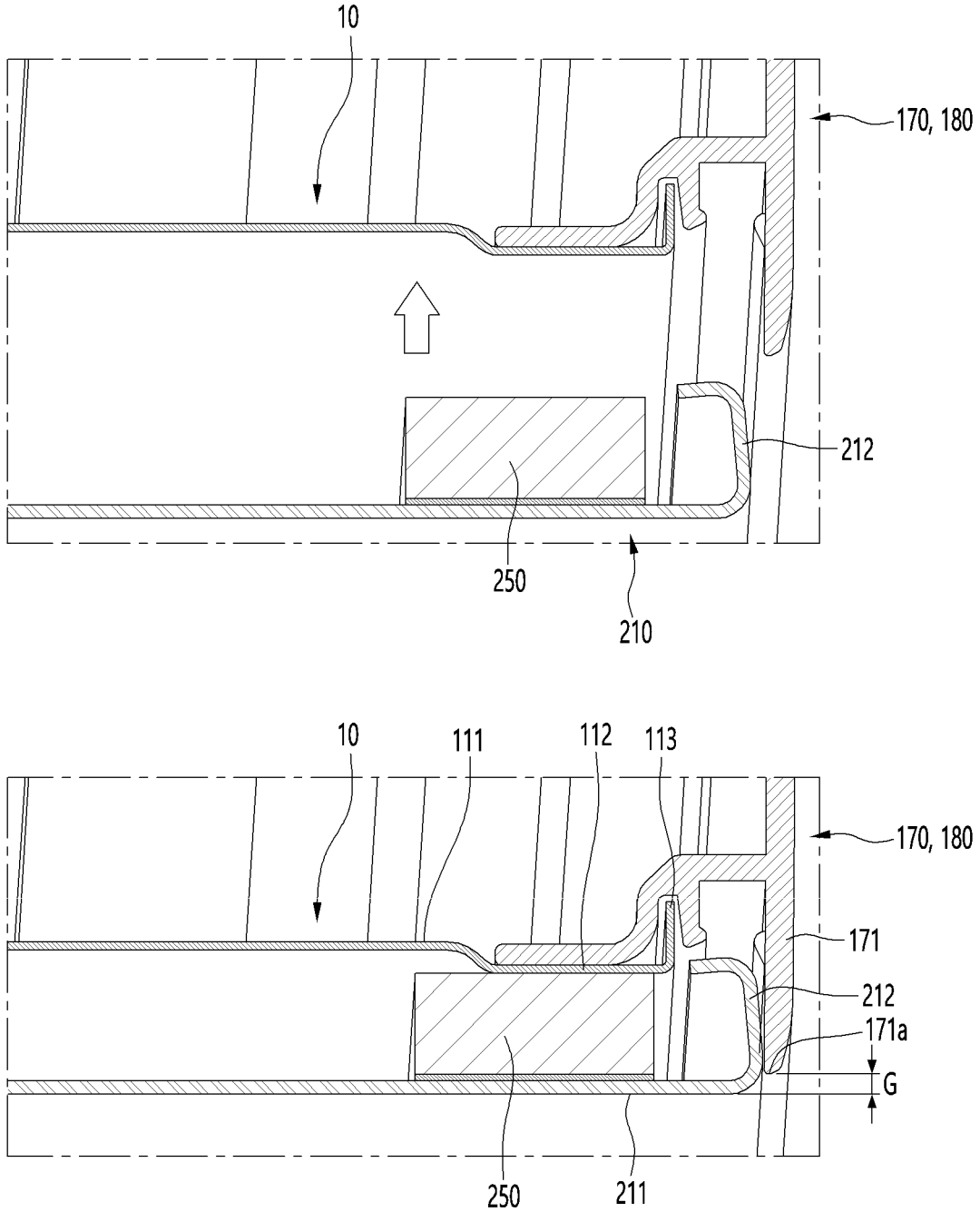
FIG. 14 is a view illustrating a state before and after the panel assembly and the frame assembly are coupled by a side coupling mechanism.
Figure 15:
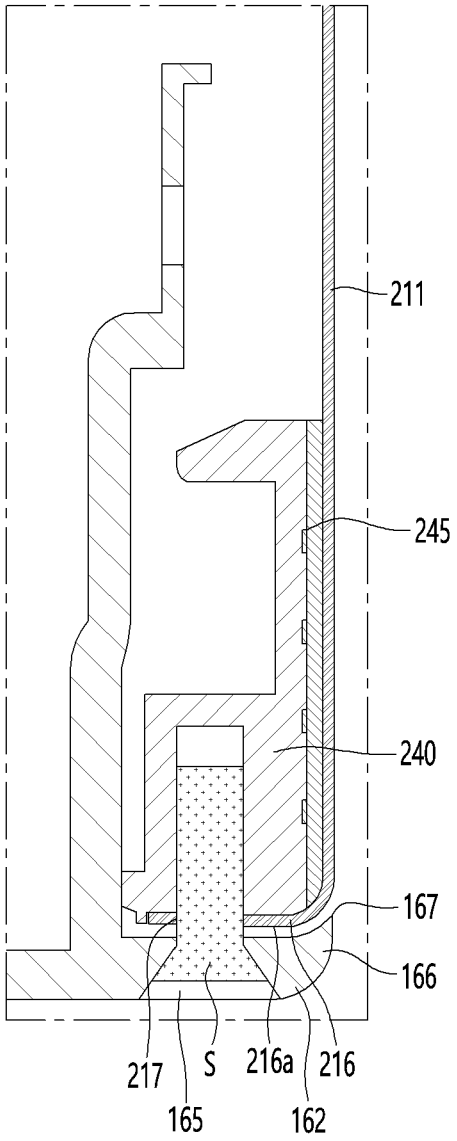
FIG. 15 is a view illustrating a state where the panel assembly and the frame assembly are coupled by a lower coupling mechanism.

FIG. 14 is a view illustrating a state before and after the panel assembly and the frame assembly are coupled by a side coupling mechanism, and FIG. 15 is a view illustrating a state where the panel assembly and the frame assembly are coupled by a lower coupling mechanism.

Referring to FIG. 14, after the upper part of the panel assembly 200 is primarily coupled to the frame assembly 100 by the upper coupling mechanism, the panel assembly 200 may be coupled to the frame assembly 100 by the side coupling mechanism in the process in which the lower part of the panel assembly 200 rotates in a direction closer to the frame assembly 100.

As an example, when both side portions of the panel assembly 200 are close to the frame assembly 100 sides, a pair of side flange parts 212 of the front panel 210 are positioned between the first parts 171 of the side frames 170 and 180 provided on both sides of the front frame. In addition, when the distance between the magnet 250 provided on the front panel 212 and the second portion 112 of the front frame 110 is within a predetermined distance, the magnet 250 is attached to the second portion 112 by the attractive force of the magnet 250 and the front frame 110 so that the front panel 210 is fixed to the front frame 110.

When both sides of the panel assembly 200 are coupled to the frame assembly 100 by the magnet 250, a part of the side flange part 212 of the front panel 210 may be positioned between the third portion 113 of the front frame 210 and the first part 171 of the side frames 170 and 180.

At least a part of the first part 171 of the side frames 170 and 180 may be in contact with the side flange part 212 of the front panel 210. In other words, the first part 171 of the side frames 170 and 180 may cover at least a part of the side surface (for example, the side flange part 212) of the front panel 210.

In addition, the front end 171*a* of the first part 171 may be located behind the front surface 211 of the front panel 210. Accordingly, a gap G of a predetermined length exists between the front end 171*a* of the first part 171 and the front surface 211 of the front panel 210.

According to this structure, it can be prevented that a gap is formed between the side flange part 212 and the first part 171 in a state where both sides of the panel assembly 200 are coupled to the frame assembly 100 by the magnet 250, and a state where the side flange part 212 and the first part 171 are in contact with each other can be stably maintained.

In a state where the front panel 210 is supported by the support part 162 of the lower frame 160 as illustrated in FIG. 11C, by a lower coupling mechanism, as illustrated in FIG. 15, the lower part of the panel assembly 200 may be fixed to the frame assembly 100.

As an example, in a state where the front panel 210 is supported by the support part 162 of the lower frame 160, the lower coupling part 244 of the lower bracket 240 and the fastening hole 217 of the lower flange part 215 may be aligned with the coupling hole 165 provided in the support part 162.

In this state, the fastening member (S) from the lower side of the support part 162 is fastened to the coupling hole 165, the fastening hole 217, and the lower coupling part 244.

In the case of the present embodiment, since the user fastens the fastening member S from the lower side of the frame assembly 100, the panel assembly 200 may be coupled to the frame assembly 100 regardless of the size of the space above the frame assembly 100.

After the panel assembly 200 is fixed to the frame assembly 100 by the fastening member S, by an external force or during a moving process or installation process of the refrigerator, other than the user's separation action, the panel assembly 200 may be prevented from being separated from the frame assembly 100.

Meanwhile, referring to FIG. 12, a front end part 147*a* of the upper extension part 146 of the upper frame 140 may be formed to be rounded downward.

In other words, in a state where the panel assembly 200 is coupled to the frame assembly 100 by an upper coupling mechanism, the front end part 146*a* of the upper extension part 146 may be positioned to correspond to a portion in which the upper flange part 214 is bent in the front panel 210.

The front end part 146*a* of the upper extension part 146 may be positioned lower than at least a part of the upper surface 214*a* of the upper flange part 214. Accordingly, the front end part 146*a* of the upper extension part 146 may serve as a center of rotation of the panel assembly 200 in the bonding process of the panel assembly 200.

In addition, as the front end part 146*a* of the upper extension part 146 is positioned lower than at least a part of the upper surface 214*a* of the upper flange part 214, when viewed from the outside, since the boundary part between the upper extension part 146 and the upper flange part 214 is not visible from the outside, the aesthetics are improved, and foreign matters can be prevented from flowing into the boundary part between the upper extension part 146 and the upper flange part 214.

Further, referring to FIG. 15, the front end part 166 of the support part 162 of the lower frame 140 may be formed to be rounded upward.

In other words, in a state where the panel assembly 200 is coupled to the frame assembly 100 by a lower coupling mechanism, the front end part 166 of the support part 162 may be positioned corresponding to a portion in which the lower flange part 216 is bent.

The upper end 167 of the front end part 166 of the support part 162 may be positioned higher than a part of the lower surface 216*a* of the lower flange part 216.

As the upper end 167 of the front end part 166 of the support part 162 is positioned higher than a part of the lower surface 216*a* of the lower flange part 216, when viewed from the outside, since the boundary part between the support part 162 and the lower flange part 216 is not visible from the outside, the aesthetics are improved, and foreign matter can be prevented from flowing into the boundary between the support part 162 and the lower flange part 216.

Meanwhile, since the process of separating the panel assembly 200 from the frame assembly 100 is the opposite of the process of coupling the panel assembly 200 to the frame assembly 100, a detailed description thereof will be omitted. However, after separating the fastening member S, one side surface of the panel assembly 200 can be easily separated from the frame assembly 100 by inserting a working tool into the tool hole 169.

Hereinafter, an embodiment in which the front panel is formed of glass material will be described.

When the front panel is formed of glass material, the thickness thereof increases compared to that of metal material. In addition, when the front panel is formed of glass material, unlike being formed of metal material, the front panel does not include a flange part.

When the front panel is formed of glass material, compared to the case where it is formed of metal material, the structures of the upper and lower coupling mechanisms are the same, and the structures of the side coupling mechanisms are different.

Hereinafter, a characteristic part of the present embodiment will be described.

Figure 16:
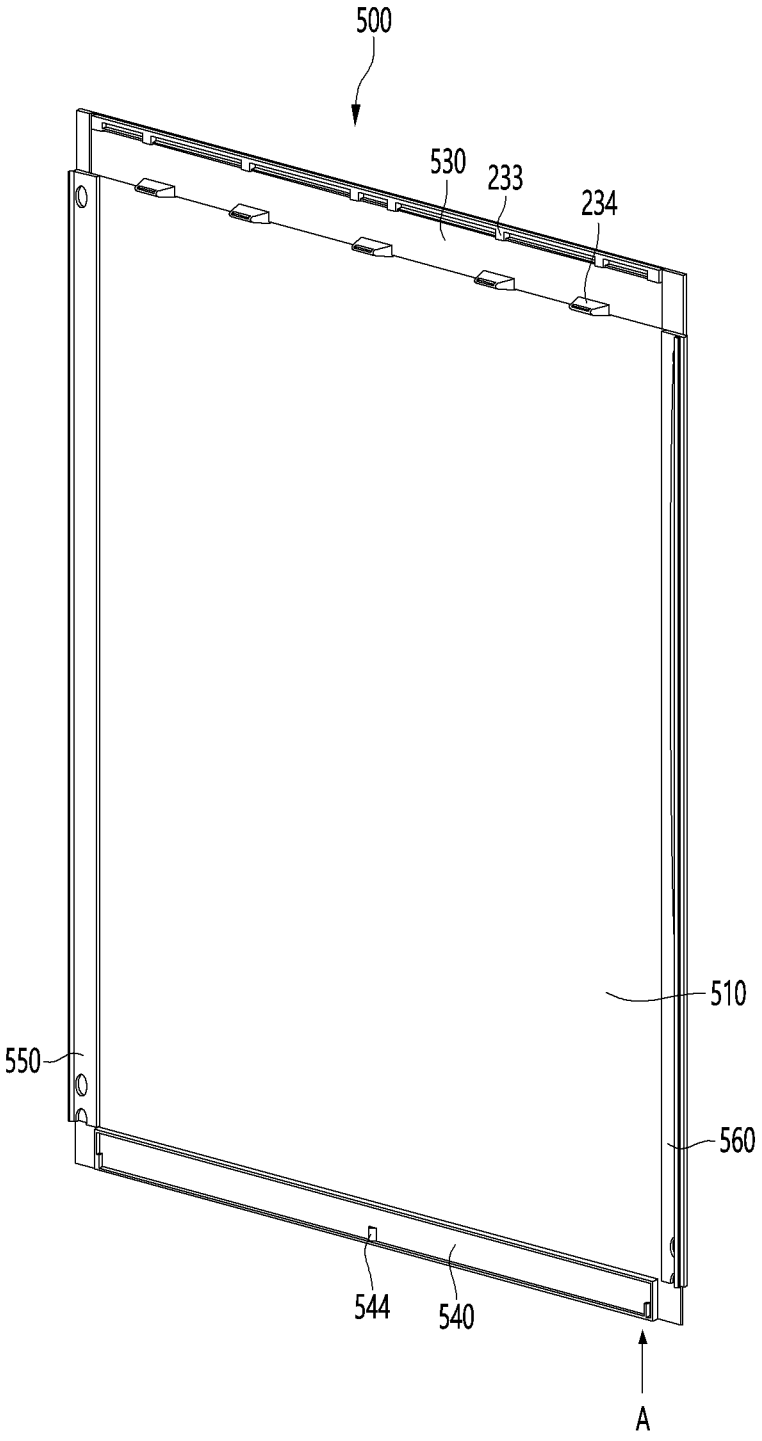
FIG. 16 is a perspective view illustrating the rear side of the panel assembly according to the second embodiment of the present disclosure.

FIG. 16 is a perspective view illustrating the rear side of the panel assembly according to the second embodiment of the present disclosure.

Referring to FIG. 16, the panel assembly 500 of the present embodiment may include a front panel 510 made of glass material, and an upper bracket 530 and a lower bracket 540 coupled to the rear surface of the front panel 510.

Since the structures of the upper bracket 530 and the lower bracket 540 of the present embodiment are the same as those of the upper bracket 230 and the lower bracket 240 described in the first embodiment, a detailed description thereof will be omitted.

In the case of the same structure as the first embodiment in the upper bracket 530 and the lower bracket 540 in FIG. 16, the same reference numerals are used.

The panel assembly 500 may further include a pair of side brackets 550 and 560 disposed between the upper bracket 530 and the lower bracket 540 and spaced apart in a horizontal direction.

Figure 17:
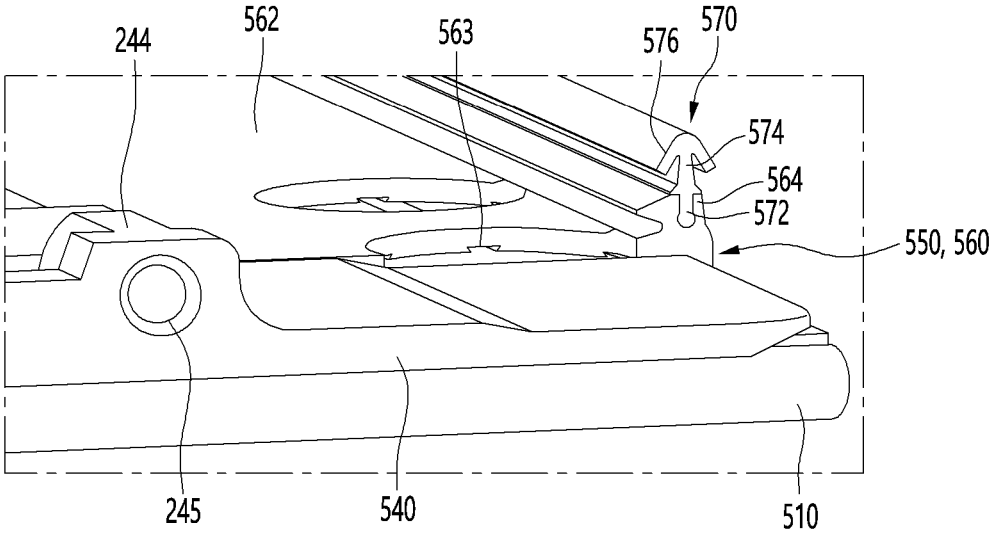
FIG. 17 is a view illustrating a side bracket coupled to the rear surface of the front panel according to the second embodiment of the present disclosure.

FIG. 17 is a view illustrating a side bracket coupled to the rear surface of the front panel according to the second embodiment of the present disclosure.

Referring to FIG. 17, the side brackets 550 and 560 may be fixed to the rear surface of the front panel 510 by an adhesive or tape.

When each of the side brackets 550 and 560 is attached to the rear surface of the front panel 510 by an adhesive, so that the adhesion force between the side brackets 550 and 560 and the front panel 510 increases, a groove 563 may be formed on a surface facing the rear surface of the front panel 510 from the side brackets 550 and 560. In this case, since the adhesive may be introduced into the groove 563, the bonding force between the side brackets 550 and 560 and the front panel 510 by the adhesive may increase.

The side brackets 550 and 560 may include a first bracket part 562 fixed to the rear surface of the front panel 210, a second bracket part 564 protruding from the first bracket part 562, and a frame coupling part 570 coupled to the second bracket part 564.

The second bracket part 564 may protrude from the first bracket 562 toward the frame assembly.

The second bracket part 564 may have a hardness greater than that of the frame coupling part 570. For example, the second bracket part 564 may be formed of ABS material, and the frame coupling part 570 may be formed of urethane material or rubber material.

The frame coupling part 570 may be manufactured separately and coupled to the second bracket part 564 or may be integrally formed with the second bracket part 564 by double extrusion.

The frame coupling part 570 may include a connection part 572 connected to the second bracket part 546, an extension part 574 extending from the connection part 572, and a hook part 576 provided in the extension part 574. The hook part 576 is formed in an arrow shape and may include a pair of engagement parts.

Figure 18:
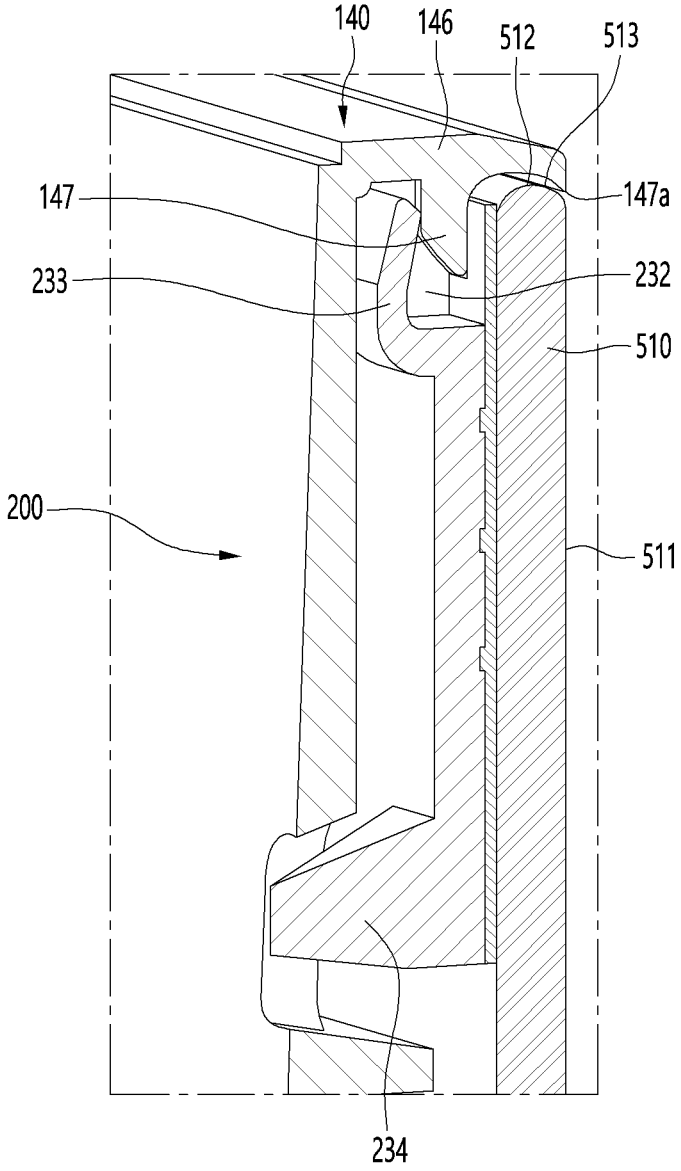
FIG. 18 is a view illustrating a state of a coupling protrusion and a coupling groove in a coupled state of the panel assembly and the frame assembly according to the second embodiment.
Figure 19:
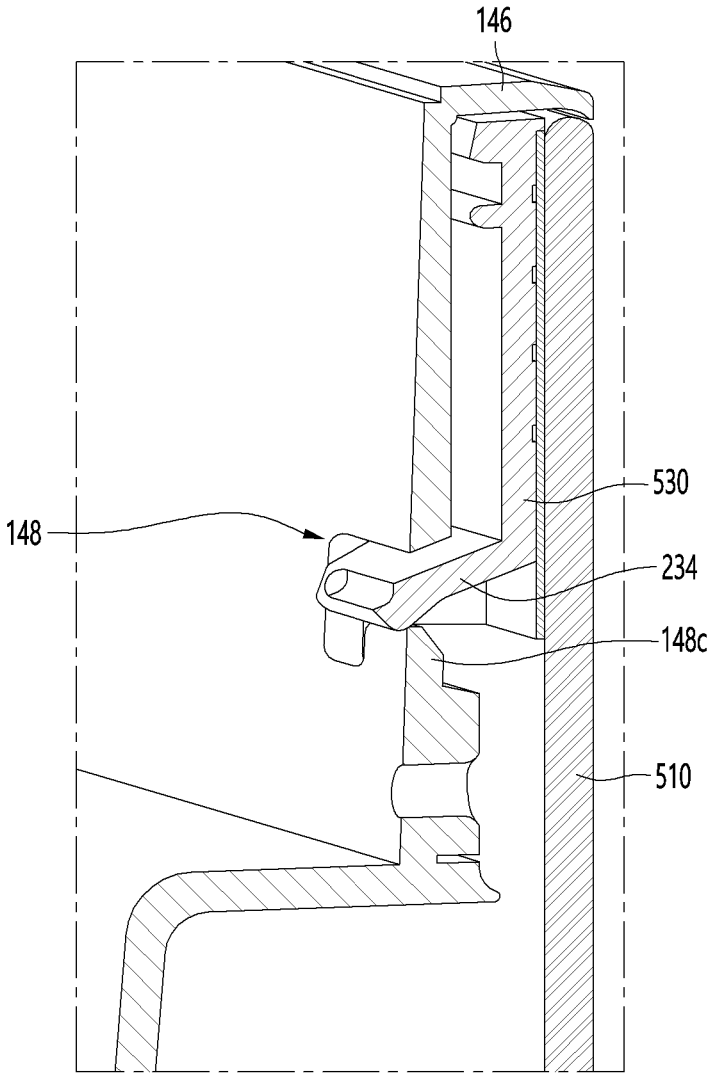
FIG. 19 is a view illustrating states of a first locking part and a second locking part in a state where the panel assembly and the frame assembly of the second embodiment are coupled.
Figure 20:
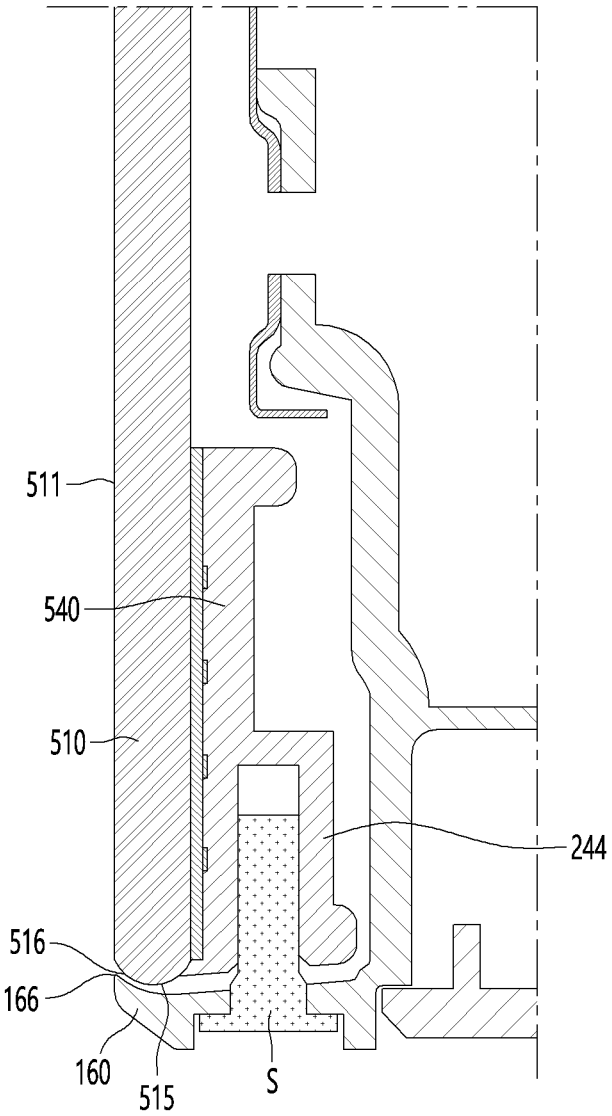
FIG. 20 is a view illustrating a state where the panel assembly and the frame assembly of the second embodiment are coupled by a lower coupling mechanism.

FIG. 18 is a view illustrating a state of a coupling protrusion and a coupling groove in a coupled state of the panel assembly and the frame assembly according to the second embodiment, FIG. 19 is a view illustrating states of a first locking part and a second locking part in a state where the panel assembly and the frame assembly of the second embodiment are coupled, and FIG. 20 is a view illustrating a state where the panel assembly and the frame assembly of the second embodiment are coupled by a lower coupling mechanism.

Referring to FIGS. 18 and 19, in order to couple the panel assembly 500 to the frame assembly 200 in the present embodiment, the upper coupling mechanism may include the coupling protrusion 147 and the coupling groove 232, a first locking part 234, and a second locking part 148, described in the first embodiment.

The coupling protrusion 147 may be received in the coupling groove 232, and the first locking part 234 may be supported by the support protrusion 148*c* of the second locking part 148.

The front panel 510 may include a front surface 511, an upper surface 512 (or upper end part), and a connection surface 513 connecting the front surface 511 and the upper surface 512. At least a part of the connection surface 513 may be rounded.

The front end part 147*a* of the upper extension part 146 of the upper frame 140 may be formed to be rounded downward.

In other words, in a state where the panel assembly 500 is coupled to the frame assembly 100 by an upper coupling mechanism, the front end part 147*a* of the upper extension part 146 may be positioned to correspond to the connection surface 513 in the front panel 510.

The front end part 147*a* of the upper extension part 146 may be positioned lower than the upper surface 512 of the front panel 510. Accordingly, the front end part 147*a* of the upper extension part 146 may serve as a center of rotation of the panel assembly 200 during the bonding process of the panel assembly 200.

In addition, as the front end part 147*a* of the upper extension part 146 is positioned lower than the upper surface 512 of the front panel 510, when viewed from the outside, the boundary part between the upper extension part 146 and the upper surface 512 of the front panel 510 is not visible from the outside, the aesthetics are improved, and foreign matters can be prevented from flowing into the boundary part between the upper extension part 146 and the upper surface 512 of the front panel 510.

Referring to FIG. 20, the front panel 510 may include the front surface 511, the lower surface 515 (or upper end part), and a connection surface 516 connecting the front surface 511 and the lower surface 515. At least a part of the connection surface 516 may be rounded.

The front end part 166 of the support part 162 of the lower frame 160 may be formed to be rounded upward.

In other words, in a state where the panel assembly 500 is coupled to the frame assembly 100 by a lower coupling mechanism, the front end part 166 of the support part 162 may be positioned to correspond to a connection surface 516 at the front panel 510.

The upper end of the front end part 166 of the support part 162 may be positioned lower than a part of the lower surface 515 of the front panel 510.

As the front end part 166 of the support part 162 is positioned lower than a part of the lower surface 515 of the front panel 510, when viewed from the outside, since the boundary part between the support part 162 and the lower surface 515 of the front panel 510 is not visible from the outside, the aesthetics are improved, and foreign matters can be prevented from flowing into the boundary part between the support part 162 and the lower surface 515 of the front panel 510.

Figure 21:
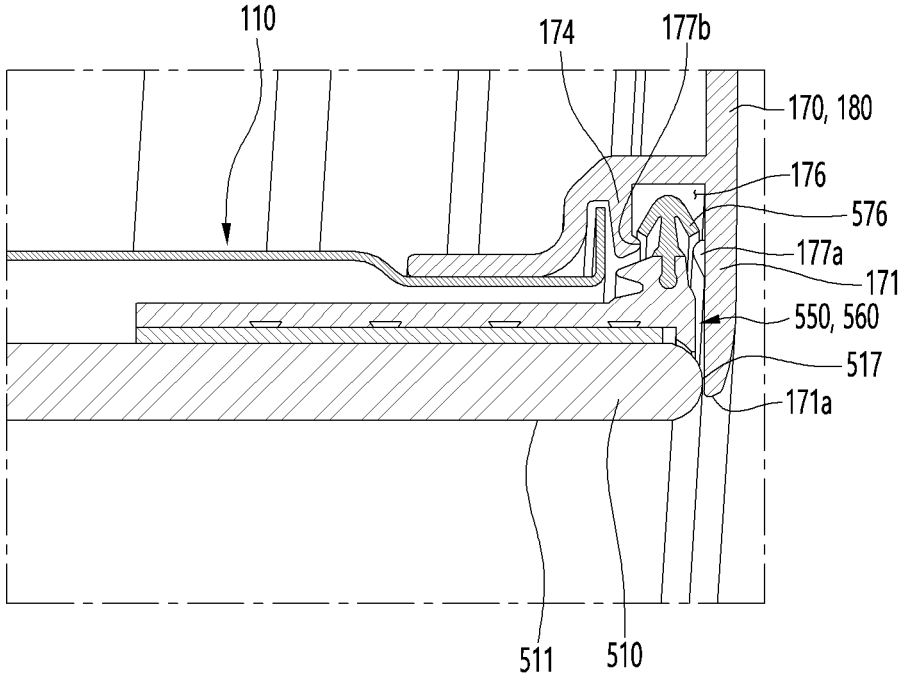
FIG. 21 is a view illustrating a state where the panel assembly and the frame assembly of the second embodiment are coupled by a side coupling mechanism.

FIG. 21 is a view illustrating a state where the panel assembly and the frame assembly of the second embodiment are coupled by a side coupling mechanism.

Referring to FIG. 21, after the upper part of the panel assembly 500 is primarily coupled to the frame assembly 100 by the upper coupling mechanism, both side parts of the panel assembly 500 may be coupled to the frame assembly 100 by the side coupling mechanisms 550 and 560 in the process of rotating the lower part of the panel assembly 500 in a direction closer to the frame assembly 100.

As an example, when both side parts of the panel assembly 500 are closer to the frame assembly 100 sides, a pair of side surfaces 517 of the front panel 510 are positioned between the first parts 171 of the side frames 170 and 180 provided on both sides of the front frame 110.

In addition, the hook part 576 of the frame coupling part 570 is introduced into the space 176 between the first part 171 and the fourth part 174.

A first engagement protrusion 177*a* may be formed in the first part 171, and a second engagement protrusion 177*b* may be formed in the fourth part 174. The first locking protrusion 177*a* and the second locking protrusion 177*b* of the first part 171 are disposed so as to face each other, and when the hook part 576 passes between the first engagement protrusion 177*a* and the second engagement protrusion 177*b* and is completely inserted into the space 176, the hook part 576 engages each of the first engagement protrusion 177*a* and the second engagement protrusion 177*b*, and thus the coupling of the frame coupling part 570 and the side frames 170 and 180 is completed. At least a part of the first part 171 of the side frames 170 and 180 may be in contact with the side surface 517 of the front panel 510. In addition, the front end 171*a* of the first part 171 may be positioned behind the front surface 511 of the front panel 510.

According to this structure, in a state where the frame coupling part 570 and the side frames 170 and 180 are coupled, the formation of a gap between the side surface 517 of the front panel 510 and the first part 171 can be prevented.

Meanwhile, since the process of separating the panel assembly 500 from the frame assembly 100 is the opposite of the process of coupling the panel assembly 500 to the frame assembly 100, a detailed description thereof will be omitted. However, after separating the fastening member S is separated therefrom, if the work tool is inserted into the tool hole 169, the work tool pushes the second bracket part 564 in a direction away from the frame assembly 100 (in the front direction), and thus a part of the side surface of the panel assembly 500 is separated from the frame assembly 100.

Figure 22:
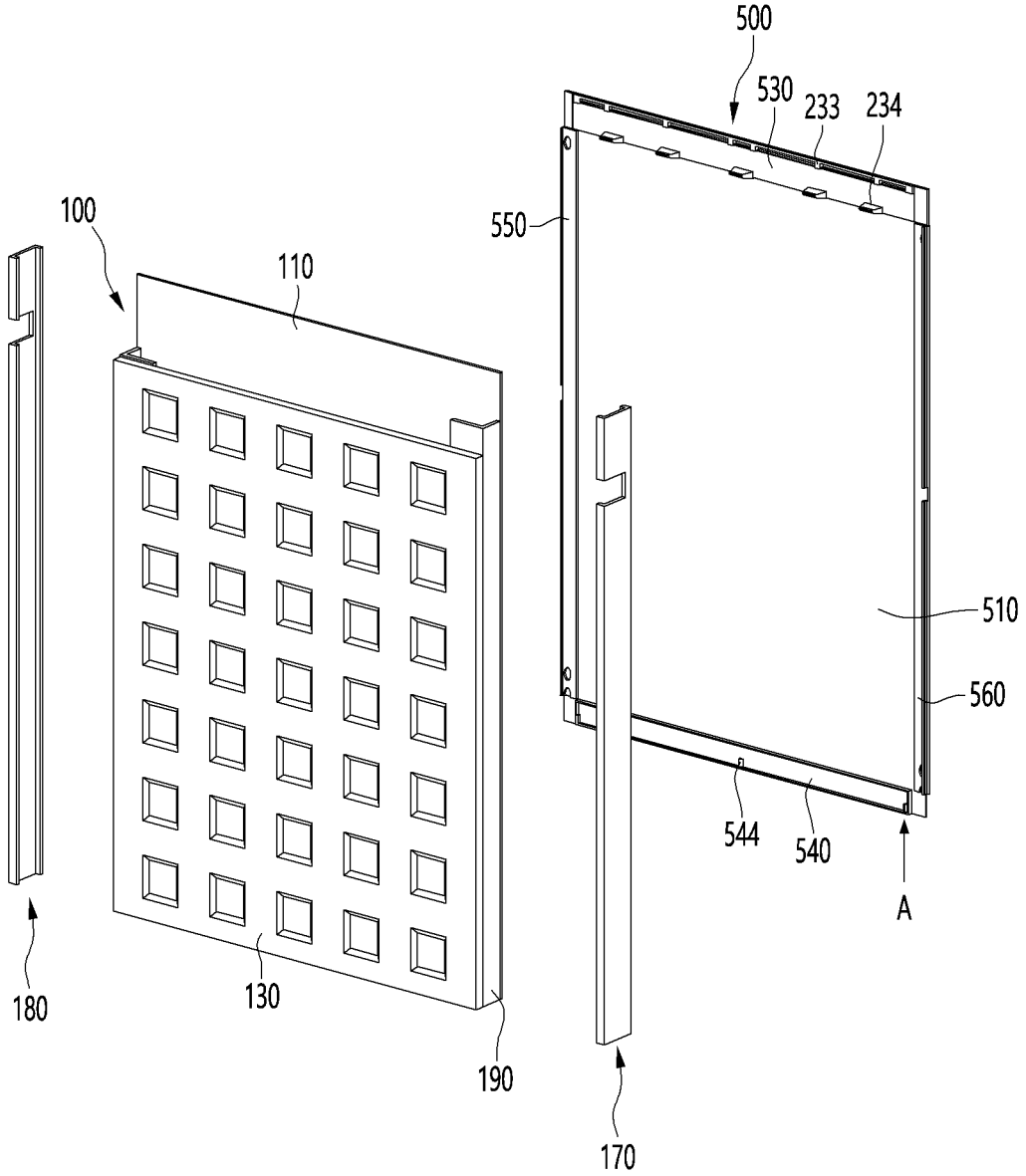
FIG. 22 is an exploded perspective view illustrating a refrigerator door according to a third embodiment of the present disclosure.
Figure 23:
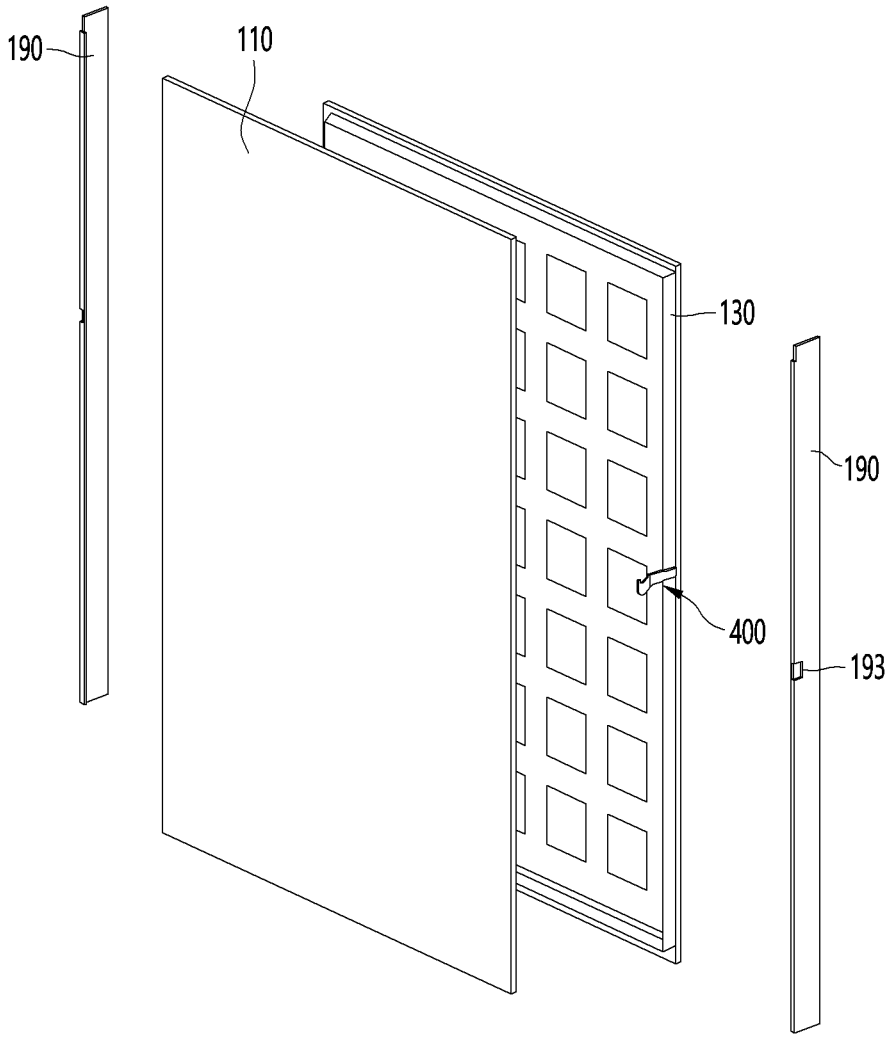
FIG. 23 is an exploded perspective view illustrating a frame assembly according to a third embodiment of the present disclosure.

FIG. 22 is an exploded perspective view illustrating a refrigerator door according to a third embodiment of the present disclosure, and FIG. 23 is an exploded perspective view illustrating a frame assembly according to a third embodiment of the present disclosure.

This embodiment is the same as the second embodiment in other parts and additionally, has a difference in further including a locking member and a structure for being coupled to the locking member. Therefore, hereinafter, only characteristic parts of the present embodiment will be described. In addition, the same reference numerals are used for the same configurations as those of the previous embodiments.

In FIGS. 22 and 23, the upper frame and the lower frame are omitted.

Referring to FIGS. 22 and 23, the refrigerator door of the present embodiment may include a frame assembly 100 and a panel assembly 500 coupled to the frame assembly.

The frame assembly 100 may include a front frame 110, a door liner 130, and first and second side frames 170 and 180.

The frame assembly 100 may further include an inner panel 190 positioned between surfaces of the first and second side frames 170 and 180 facing each other.

The inner panel 190 may be in contact with each of the side frames 170 and 180 to prevent the side frames 170 and 180 from being deformed by an external force.

The inner panel 190 may be positioned between the front frame 110 and the door liner 130.

The panel assembly 500 may include a front panel 510 made of glass material, and an upper bracket 530 and a lower bracket 540 coupled to the rear surface of the front panel 510.

In the case of the same structure as the second embodiment in the upper bracket 530 and the lower bracket 540 in FIG. 22, the same reference numerals were used.

The panel assembly 500 may further include a pair of side brackets 550 and 560 disposed between the upper bracket 530 and the lower bracket 540 and spaced apart in a horizontal direction.

The frame assembly 100 may further include a locking member 400 to be coupled to the side brackets 550 and 560 of the panel assembly 500. The locking member 400 will be described later with reference to the drawings.

Figure 24:
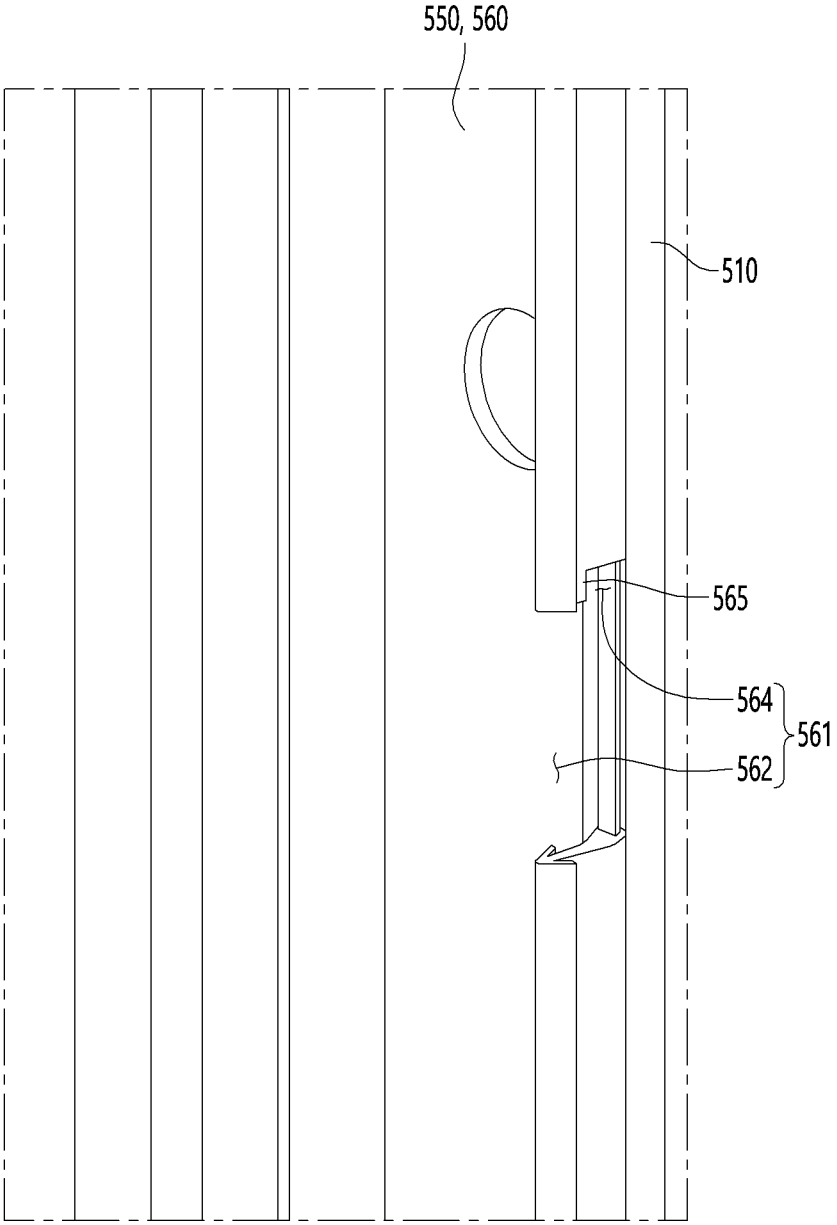
FIG. 24 is a view illustrating a side bracket according to a third embodiment of the present disclosure.

FIG. 24 is a view illustrating a side bracket according to a third embodiment of the present disclosure.

Referring to FIG. 24, a locking groove 561 for coupling the locking member 400 may be provided in the side brackets 550 and 560.

In the present embodiment, the frame coupling part 570 may be formed in a part other than a part in which the locking groove 561 is formed.

The locking groove 561 may include a first groove 562 extending in the front and rear horizontal direction, and a second groove 564 extending upward from the first groove 562. The length of the second groove 564 in the front and rear direction is shorter than the length of the first groove 562 in the front and rear direction. Accordingly, an engagement part 565 configured to engage the locking member 400 may be provided at a part where the second groove 564 is positioned.

The locking member 400, the engagement part 565, and the fixing member 440 to be described later constitute a locking mechanism for coupling the panel assembly 500 and the frame assembly 100. The locking mechanism includes the locking member 400, the engagement part 565, and the fixing member 440. The locking mechanism may be configured to couple at least some of both sides of the panel assembly 500 to the frame assembly 100.

Figure 25:
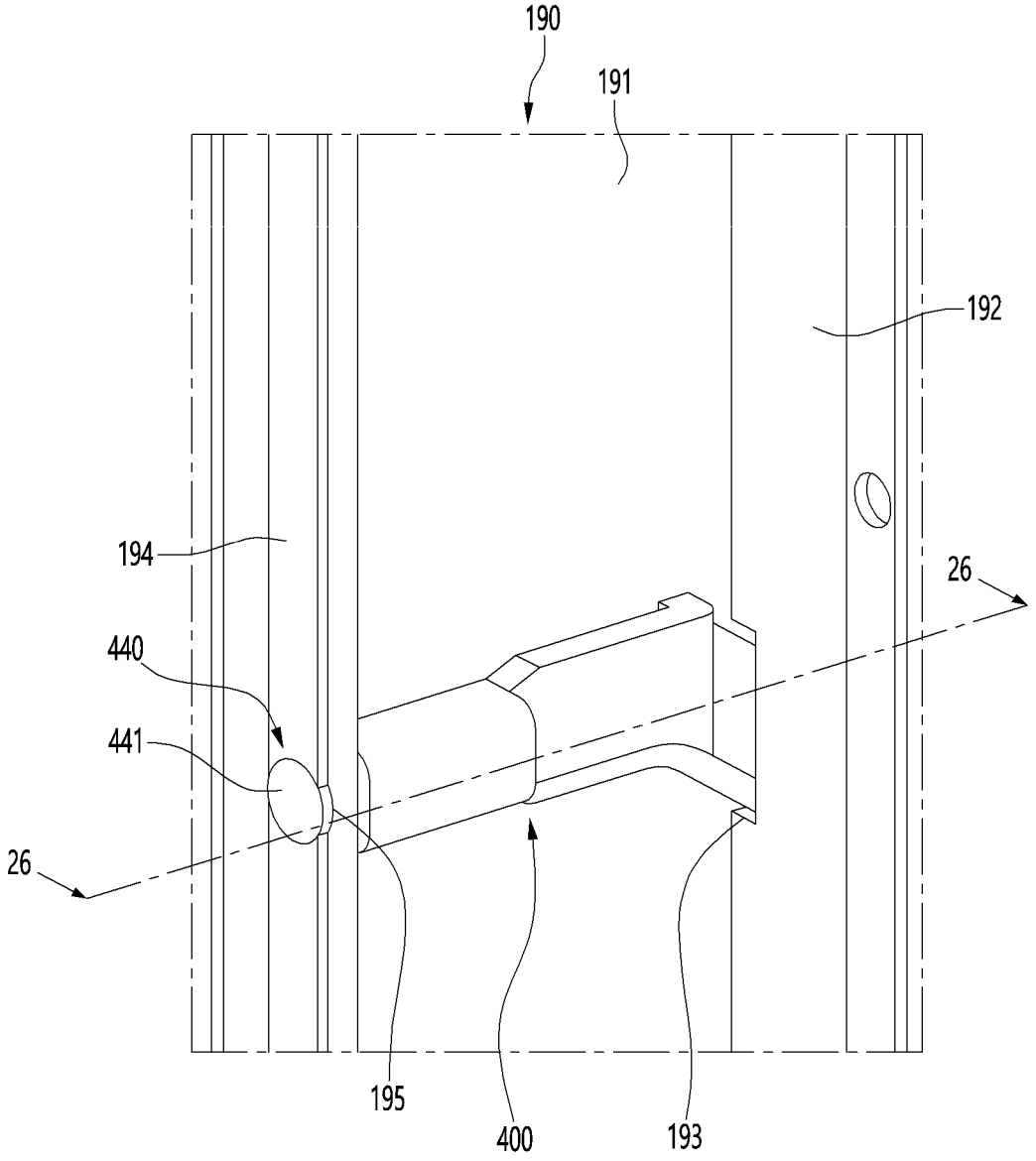
FIG. 25 is a view illustrating a locking member installed on the inner panel.
Figure 26:
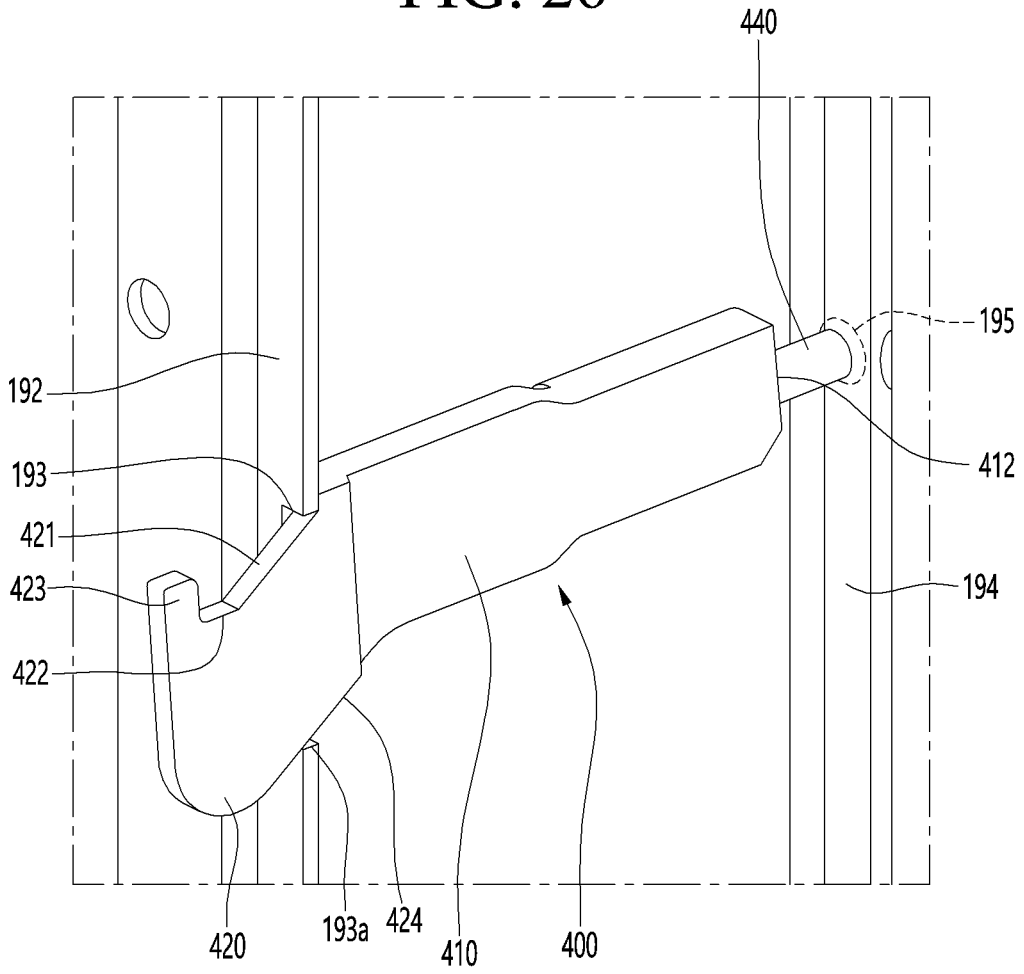
FIG. 26 is a cross-sectional view taken along line 26-26 of FIG. 25.

FIG. 25 is a view illustrating a locking member installed on the inner panel, and FIG. 26 is a cross-sectional view taken along line 26-26 of FIG. 25.

Referring to FIGS. 25 and 26, the inner panel 190 may include a panel body 191 extending in the front and rear direction, and a first extension part 192 extending from the front end of the panel body 191 in a horizontal direction, and a second extension part 194 extending from a rear end of the panel body 191 in a horizontal direction.

The first extension part 192 is spaced apart from the second extension part 194, and at least a part of the first extension part 192 may be positioned so as to face the second extension part 194.

A part of the locking member 400 may be positioned between the first extension part 192 and the second extension part 194.

A part of the locking member 400 is located between the first extension part 192 and the second extension part 194, and another part passes through the first extension part 192 to protrude forward of the extension part 192.

Although not illustrated, a separate cover is coupled to the inner panel 190, and a separate cover may cover the locking member 400. The cover serves to divide into the insulating material filled in the frame assembly and the locking member 400.

The first extension part 192 is provided with a first hole 193 through which the locking member 400 passes.

The locking member 400 may include a body part 410 and a locking part 420 extending from the body part 410. A fixing member 440 may be coupled to the body part 410. The fixing member 440 may be a bolt or a screw coupled to the opposite side of the locking part 420 in the body part 410.

A second hole 195 through which the fixing member 400 passes may be formed in the second extension part 194.

The body part 410 is positioned between the first extension part 192 and the second extension part 194, and the locking part 420 penetrates the first hole 193.

The upper surface of the locking part 420 may include an upper inclined surface 421 and a plane 422 extending in a direction away from the fixing member 440 from the upper inclined surface 421. An engagement protrusion 423 may be provided at an end part of the plane 422. The lower surface of the locking part 430 may include a lower inclined surface 424.

The lower inclined surface 424 is inclined downward in a direction away from the coupling surface 412 to be described later.

In a state before the locking member 400 is coupled with the side frames 550 and 560, the lower inclined surface 424 of the locking part 420 is in contact with the bottom 193*a* of the first hole 193 and the coupling surface 412 to which the fixing member 440 is coupled in the body part 410 is spaced apart from the second extension part 194.

In a process in which the locking member 400 is coupled to the side frames 550 and 560, the locking member 400 not only moves in the front and rear direction (the first direction) but also moves in the vertical direction. To this end, the upper and lower lengths of the first hole 193 may be formed longer than the height of the part in which the two inclined surfaces 421 and 424 are formed in the locking part 420. Accordingly, the locking member 400 may move up and down and back and forth while passing through the first hole 193 without interfering with the part where the first hole 193 is formed.

By rotating the fixing member 440 in one direction, the head 441 of the fixing member 400 and the coupling surface 412 of the body part 410 become close to each other, that is, the coupling surface 412 becomes close to the second extension part 194. Then, the engagement protrusion 423 is moved upward so that the engagement protrusion 423 engages the engagement part 565 so that the locking member 400 and the side frames 550 and 560 may be firmly coupled.

Figure 27A:
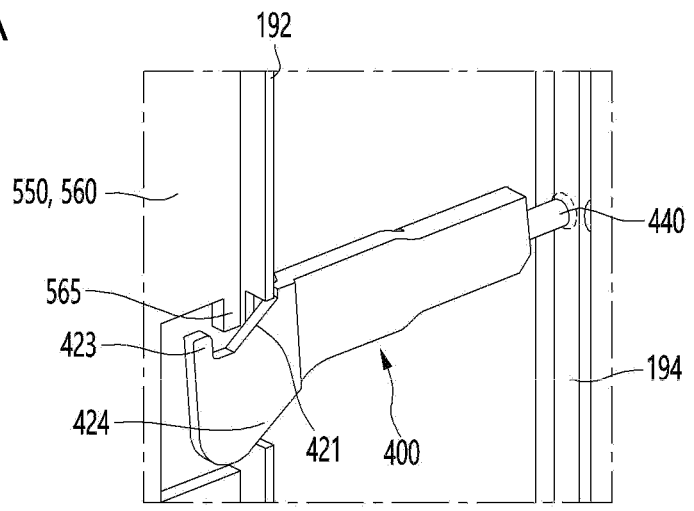
FIGS. 27A to 27C are views sequentially illustrating the process of coupling the side bracket and the locking member.
Figure 27B:
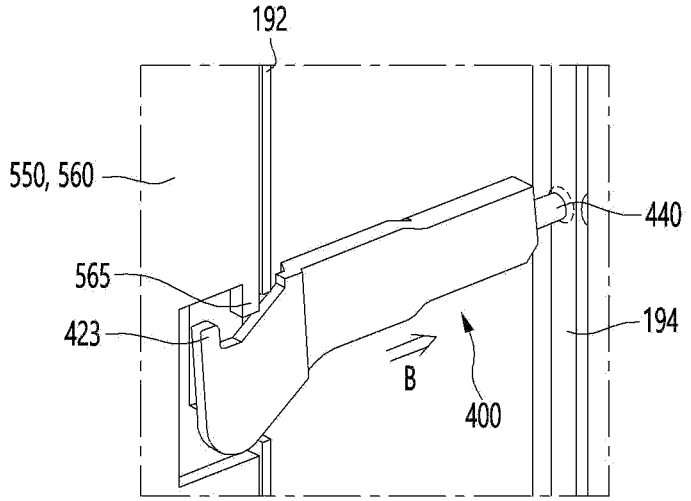
Figure 27C:
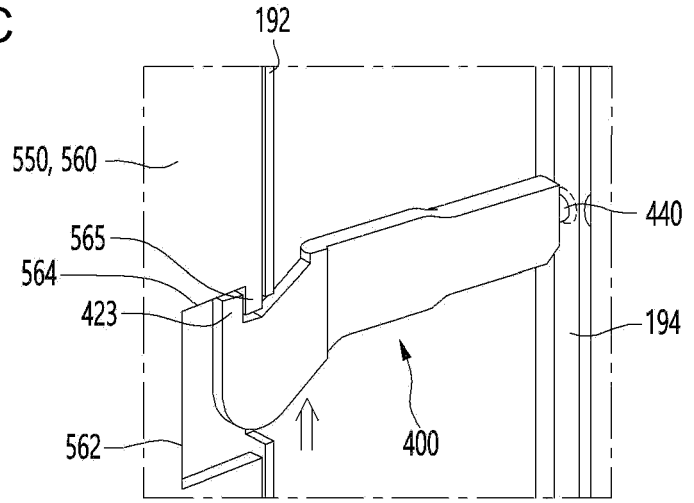

FIGS. 27A to 27C are views sequentially illustrating the process of coupling the side bracket and the locking member.

First, a process in which the upper bracket and the lower bracket of the panel assembly are coupled to the upper frame and the lower frame of the frame assembly is the same as in the second embodiment, and thus a detailed description thereof will be omitted.

Referring to FIGS. 17, 24, 26, and 27(*a*), in the process of coupling the frame coupling part 570 to the side frames 170 and 180, the engagement parts 565 of the side brackets 550 and 560 are in contact with the inclined surface 421 of the locking member 400.

At this time, the engagement part 565 is positioned lower than the engagement protrusion 423 so that the engagement part 565 does not interfere with the engagement protrusion 423 until the engagement part 565 is in contact with the inclined surface 421 of the locking member 400.

When the front panel 510 is pressed to couple the frame coupling parts 570 and 580 to the side frames 170 and 180 in a state where the engagement part 565 is in contact with the inclined surface 421, the engagement part 565 presses the inclined surface 421 so that the locking member 400 moves to the rear side (in the direction of arrow B).

At this time, as illustrated in FIG. 27B, the locking member 400 rises while moving to the rear by the inclined surfaces 421 and 424 of the upper and lower sides.

In a state where the frame coupling parts 570 and 580 are coupled to the side frames 170 and 180, the upper surface of the engagement protrusion 423 is positioned higher than the lower surface of the engagement part 565.

In this state, when the fixing member 440 is rotated in one direction, as illustrated in FIG. 27C, the locking member 400 is additionally moved to the rear, so that the coupling surface 412 becomes close to the second extension part 194, and accordingly, the engagement protrusion 423 located in the first groove 562 moves to the second groove 564 and engages the engagement part 565.

In a state where the engagement protrusion 423 engages the engagement part 565, the coupling surface 412 may be in contact with or be spaced apart from the second extension part 194. If the coupling surface 412 is in contact with the second extension part 194, the locking member 400 can be firmly fixed to the second extension part 194 by the fixing member 400.

Meanwhile, since the process of separating the panel assembly 500 from the frame assembly 100 is the opposite of the process of coupling the panel assembly 500 to the frame assembly 100, a detailed description thereof will be omitted. However, after separating the fastening member S, if the work tool is inserted into the tool hole 169, the work tool pushes the second bracket part 564 in a direction away from the frame assembly 100 (the front direction) and thus a part of the side surface of the panel assembly 500 is separated from the frame assembly 100.

In addition, when the fixing member 400 is rotated in another direction, the locking member 400 descends while moving forward away from the second extension part 194 by its own weight and thus the coupling between the locking member 400 and the side brackets 550 and 560 may be released. In other words, the engagement protrusion 423 positioned in the second groove 564 of the locking groove is moved to the first groove 562 by the weight of the locking member 400.

In the above embodiment, it has been described that both side parts of the panel assembly are fixed to the side frames 170 and 180 by the frame coupling part 570 and the locking member 400, but unlike this, it should be noted that it is also possible to be fixed by only the locking member 400.

Alternatively, it is possible to install the locking member 400 on the side frames 170 and 180 without being installed on the inner panel. In this case, each of the inner panel and the side frame may be referred to as a side panel. Then, the inner panel may be referred to as an inner side panel, and the side frame may be referred to as an outer side panel.

Meanwhile, it should be noted that the structure for replacing the panel assembly constituting the door described in the present specification is not applied only to the refrigerator and can be also applied to a structure for replacing the panel assembly in a door of a home appliance or a product without a door, as it is.

What is claimed is:

1. A refrigerator comprising:

a cabinet that defines a storage space; and a door configured to open and close at least a portion of the storage space, the door comprising:

a frame that (i) includes an upper frame portion that protrudes toward a front of the refrigerator, the upper frame portion including a coupling protrusion that extends downward, (ii) includes a lower frame portion that protrudes toward the front of the refrigerator, and (iii) defines an insulating space between the upper frame portion and the lower frame portion configured to receive insulating material, the lower frame portion defining a coupling hole, and a panel that is configured to be detachably coupled to the frame and that defines an outer appearance of the door, the panel being made from metal and including (i) an upper extension part that is bent rearward to extend in a rearward direction, (ii) a lower extension part that is bent rearward to extend in the rearward direction, and (iii) a pair of side extension parts that are bent rearward to extend in the rearward direction, each of the pair of side extension parts comprising a first bent portion that extends reward relative to a rear surface of the panel and a second bent portion that is bent from the first bent portion and faces the rear surface of the panel, wherein the upper and lower frame portions of the frame are configured, based on the panel being coupled to the frame, to partially cover at least a portion of the upper extension part and the lower extension part, respectively, wherein the upper extension part of the panel defines one or more openings configured to receive the coupling protrusion to thereby couple the upper extension part to the upper frame portion, wherein the upper extension part includes a first upper extension part that extends a first upper extension length in the rearward direction and a second upper extension part that extends a second upper extension length in the rearward direction, the second upper extension length being greater than the first upper extension length, and the one or more opening of the upper extension part being defined at the second upper extension part, and wherein the lower extension part of the panel defines one or more openings configured to be aligned with the coupling hole of the lower frame portion to thereby receive a fastening member that is inserted sequentially into the coupling hole and then into the one or more openings to thereby couple the lower extension part to the lower frame portion.

2. The refrigerator of claim 1, wherein the panel is configured, based on the coupling protrusion being inserted into the one or more openings of the upper extension part, to be rotated toward the frame such that the one or more openings of the panel become aligned with the coupling hole of the lower frame portion.

3. The refrigerator of claim 1, wherein the lower frame portion of the frame defines a cavity that is recessed rearward and that is configured to receive the lower extension part of the panel.

4. The refrigerator of claim 1, wherein the upper extension part includes an upper step portion that is positioned between the first upper extension part and the second upper extension part and that extends a predetermined upper extension length in the rearward direction, the predetermined upper extension length being greater than the first upper extension length and less than the second upper extension length of the first and second upper extension parts, respectively.

5. The refrigerator of claim 1, wherein the lower extension part includes a first lower extension part having a first lower extension length in the rearward direction and a second lower extension part having a second lower extension length in the rearward direction, the second lower extension length being greater than the first lower extension length, and wherein the one or more opening of the lower extension part are defined at the second lower extension part.

6. The refrigerator of claim 5, wherein the lower extension part includes a lower step portion that is positioned between the first lower extension part and the second lower extension part and that extends a predetermined lower extension length in the rearward direction, the predetermined lower extension length being greater than the first lower extension length and less than the second lower extension length of the first and second lower extension parts, respectively.

7. The refrigerator of claim 1, wherein each of the pair of side extension parts includes a first side extension part having a first side extension length in the rearward direction and a second side extension part having a second side extension length in the rearward direction, the second side extension length being greater than the first side extension length.

8. The refrigerator of claim 1, wherein the coupling protrusion of the upper frame portion includes a plurality of coupling protrusions, and wherein the one or more openings of the upper extension part include a plurality of openings that are configured to correspondingly receive the plurality of coupling protrusions.

9. The refrigerator of claim 1, wherein the coupling hole of the lower frame portion includes a plurality of coupling holes, and wherein the one or more openings of the lower extension part include a plurality of openings that are configured to correspondingly align with the plurality of coupling holes to thereby receive a plurality of fastening members.

10. The refrigerator of claim 1, wherein the frame further includes a front frame and a door liner that is spaced apart from the front frame, the insulating space being defined between the front frame and the door liner.

11. The refrigerator of claim 10, wherein the panel further comprises a magnet coupled to the rear surface of the panel, and wherein the front frame is made from metal.

12. The refrigerator of claim 1, wherein the panel comprises a pair of magnets located adjacent to the pair of side extension parts, respectively, and configured to magnetically couple the panel to the frame.

13. The refrigerator of claim 1, wherein, based on the panel being coupled to the frame, a frontmost part of the upper frame portion and a frontmost part of the lower frame portion are positioned a predetermined length rearward of a front surface of the panel.

14. A refrigerator comprising:

a cabinet that defines a storage space; and a door configured to open and close at least a portion of the storage space, the door comprising:

a frame that (i) includes an upper frame portion that protrudes toward a front of the refrigerator, the upper frame portion including a coupling protrusion that extends downward, (ii) includes a lower frame portion that protrudes toward the front of the refrigerator, and (iii) defines an insulating space between the upper frame portion and the lower frame portion configured to receive insulating material, the lower frame portion defining a coupling hole, and a panel that is configured to be detachably coupled to the frame and that defines an outer appearance of the door, the panel being made from metal and including (i) an upper extension part that is bent rearward to extend in a rearward direction, (ii) a lower extension part that is bent rearward to extend in the rearward direction, and (iii) a pair of side extension parts that are bent rearward to extend in the rearward direction, wherein laterally opposite ends of the upper extension part are integrated with the pair of side extension parts at upper corner regions of the panel, the integrated upper corner regions extending a first length in the rearward direction, and wherein a coupling region of the upper extension part located between the laterally opposite ends of the upper extension part extends a second length in the rearward direction, the second length being greater than the first length, the coupling region defining one or more openings configured to receive the coupling protrusion to thereby couple the upper extension part to the upper frame portion, wherein the upper and lower frame portions of the frame are configured, based on the panel being coupled to the frame, to partially cover at least a portion of the upper extension part and the lower extension part, respectively, wherein the lower extension part of the panel defines one or more openings configured to be aligned with the coupling hole of the lower frame portion to thereby receive a fastening member that is inserted sequentially into the coupling hole and then into the one or more openings to thereby couple the lower extension part to the lower frame portion, and wherein the frame defines a cavity that is recessed to receive the lower extension part of the panel.

15. The refrigerator of claim 14, wherein the upper extension part includes an upper step portion that is positioned between the coupling region of the upper extension part and the integrated upper corner regions of the upper corner regions and that extends a predetermined length in the rearward direction, the predetermined length being greater than the first length and less than the second length.

16. The refrigerator of claim 14, wherein laterally opposite ends of the lower extension part are integrated with the pair of side extension parts at lower corner regions of the panel, the integrated lower corner regions extending a third length in the rearward direction, and a coupling region of the lower extension part located between the laterally opposite ends of the lower extension part extends a fourth length in the rearward direction, the fourth length being greater than the third length, and wherein the one or more openings of the lower extension part are provided at the coupling region of the lower extension part.

17. The refrigerator of claim 14, wherein the cavity is recessed rearward at the lower frame portion of the frame to thereby receive the lower extension part of the panel.

18. The refrigerator of claim 14, wherein the frame further includes a front frame and a door liner that is spaced apart from the front frame, the insulating space being defined between the front frame and the door liner.

19. The refrigerator of claim 18, wherein the panel further comprises a magnet coupled to a rear surface of the panel, and wherein the front frame is made from metal.

20. The refrigerator of claim 14, wherein the panel comprises a pair of magnets located adjacent to the pair of side extension parts, respectively, and configured to magnetically couple the panel to the frame.

* * * * *